US011465020B2

(12) United States Patent
Hebreo et al.

(10) Patent No.: US 11,465,020 B2
(45) **Date of Patent: *Oct. 11, 2022**

(54) DOUBLE-WALL IRON WITH COMPOSITE INNER WALL

(71) Applicant: Acushnet Company, Fairhaven, MA (US)

(72) Inventors: Jonathan Hebreo, San Diego, CA (US); Doug M. Takehara, San Clemente, CA (US); Joshua G. Breier, Vista, CA (US); Ryuichi Sugimae, San Diego, CA (US); Nick Frame, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/988,406

(22) Filed: Aug. 7, 2020

(65) Prior Publication Data

US 2020/0368591 A1 Nov. 26, 2020

Related U.S. Application Data

(63) Continuation-in-part of application No. 16/434,015, filed on Jun. 6, 2019, now Pat. No. 10,737,151, which (Continued)

(51) Int. Cl.

| | |
|---|---|
| ***A63B 53/04*** | (2015.01) |
| ***A63B 60/52*** | (2015.01) |
| ***A63B 60/54*** | (2015.01) |

(52) U.S. Cl.
CPC ..... *A63B 53/0475* (2013.01); *A63B 53/0466* (2013.01); *A63B 60/52* (2015.10); (Continued)

(58) Field of Classification Search
CPC . A63B 53/0475; A63B 53/0466; A63B 60/52; A63B 53/0433; A63B 60/54; A63B 53/0416; A63B 2209/00
(Continued)

(56) References Cited

U.S. PATENT DOCUMENTS

| | | | |
|---|---|---|---|
| 4,884,812 | A | 12/1989 | Nagasaki |
| 5,083,778 | A | 1/1992 | Douglass |

(Continued)

FOREIGN PATENT DOCUMENTS

| | | |
|---|---|---|
| CN | 102448552 | 5/2012 |
| CN | 102574007 | 7/2012 |

(Continued)

*Primary Examiner* — Sebastiano Passaniti
(74) *Attorney, Agent, or Firm* — Randy K. Chang

(57) ABSTRACT

A golf club head includes a golf club head body, a striking face, and an inner wall supporting the striking face. A ledge extends from a body into the interior of the golf club head body, and the inner wall is disposed within a gap between the striking face and the ledge. A rear surface of the inner wall is supported by a portion of the golf club head body, and a rear surface of the striking face is in contact with a portion of the inner wall. The inner wall may be inserted into the golf club head through an opening defined in the toe portion of the golf club head or the rear portion of the golf club head.

9 Claims, 34 Drawing Sheets

Related U.S. Application Data is a continuation of application No. 15/844,286, filed on Dec. 15, 2017, now Pat. No. 10,350,468, which is a continuation-in-part of application No. 15/184,688, filed on Jun. 16, 2016, now Pat. No. 10,065,088.

(52) U.S. Cl.
CPC ..... *A63B 53/0416* (2020.08); *A63B 53/0433* (2020.08); *A63B 60/54* (2015.10); *A63B 2209/00* (2013.01)

(58) Field of Classification Search
USPC ..... 473/324–350, 287–292
See application file for complete search history.

(56) References Cited

U.S. PATENT DOCUMENTS 5,288,070 A 2/1994 Chen
5,295,689 A 3/1994 Lundberg
5,398,929 A 3/1995 Kitaichi
5,766,092 A * 6/1998 Mimeur ..... A63B 60/00 473/329
5,839,975 A 11/1998 Lundberg
5,863,261 A 1/1999 Eggiman
6,074,309 A 6/2000 Mahaffey
6,299,547 B1 10/2001 Kosmatka
6,743,117 B2 6/2004 Gilbert
6,746,342 B1 * 6/2004 Hsieh ..... A63B 53/047 473/342
6,918,841 B2 7/2005 Chen
6,932,717 B2 * 8/2005 Hou ..... A63B 53/047 473/332
6,964,620 B2 11/2005 Gilbert
7,056,229 B2 6/2006 Chen
7,121,958 B2 * 10/2006 Cheng ..... A63B 53/047 473/345
7,247,104 B2 7/2007 Poynor
7,258,628 B2 * 8/2007 Huang ..... A63B 53/0466 473/342
7,281,990 B2 10/2007 Hagood
7,371,188 B2 * 5/2008 Chen ..... A63B 53/04 473/329
7,544,136 B2 * 6/2009 Tsai ..... A63B 53/047 473/342
7,582,024 B2 9/2009 Shear
7,651,408 B2 1/2010 Hagood
7,662,051 B2 2/2010 Chen
8,012,040 B2 * 9/2011 Takechi ..... A63B 53/04 473/329
8,016,691 B2 9/2011 Stites
8,475,293 B2 7/2013 Morin
8,608,585 B2 * 12/2013 Stites ..... A63B 60/00 473/282
8,801,540 B2 8/2014 Hebreo et al.
8,911,301 B1 12/2014 Allen
9,033,817 B2 * 5/2015 Snyder ..... A63B 60/54 473/324
9,138,622 B1 9/2015 DeMille
9,199,141 B2 12/2015 Cardani
9,457,241 B2 10/2016 Hebreo
9,474,945 B2 10/2016 Fossum
9,662,549 B2 * 5/2017 Vrska, Jr. ..... A63B 60/52
10,065,088 B2 9/2018 Hebreo et al.
10,293,223 B2 * 5/2019 Kii ..... A63B 53/047
10,343,037 B2 7/2019 Hebreo et al.
10,350,468 B2 7/2019 Hebreo et al.
2003/0119602 A1 6/2003 Kennedy
2003/0190975 A1 10/2003 Fagot
2004/0053704 A1 * 3/2004 Gilbert ..... A63B 53/047 473/290
2004/0266545 A1 12/2004 Gilbert
2005/0096156 A1 * 5/2005 Chen ..... A63B 53/047 473/350
2005/0124437 A1 * 6/2005 Imamoto ..... A63B 53/04 473/346
2005/0143188 A1 * 6/2005 Tseng ..... A63B 60/00 473/332
2005/0197207 A1 9/2005 Chen
2006/0052179 A1 * 3/2006 Hou ..... A63B 53/047 473/342
2006/0073912 A1 * 4/2006 Hsieh ..... A63B 53/047 473/350
2006/0154743 A1 7/2006 Huang
2006/0252575 A1 * 11/2006 Chen ..... A63B 60/00 473/342
2006/0252576 A1 * 11/2006 Lo ..... A63B 53/0466 473/342
2006/0293119 A1 * 12/2006 Hou ..... A63B 53/047 473/342
2007/0049415 A1 3/2007 Shear
2007/0117653 A1 * 5/2007 Yoneyama ..... A63B 53/047 473/350
2007/0178990 A1 * 8/2007 Tsai ..... A63B 53/047 473/345
2008/0194355 A1 * 8/2008 Liu ..... A63B 53/0475 473/342
2009/0325729 A1 * 12/2009 Takechi ..... A63B 53/0475 473/342
2010/0273565 A1 10/2010 Stites
2013/0196785 A1 8/2013 Takechi
2013/0281231 A1 * 10/2013 Morin ..... A63B 53/047 473/350
2018/0104552 A1 4/2018 Hebreo et al.
2018/0236324 A1 8/2018 Hebreo

FOREIGN PATENT DOCUMENTS

JP 2000-14838 1/2000
JP 2004-351173 12/2004
JP 2008-100056 5/2008
WO WO 2010-126729 11/2010

* cited by examiner

DOUBLE-WALL IRON WITH COMPOSITE INNER WALL

CROSS-REFERENCE TO RELATED APPLICATIONS

This application is a continuation-in-part of U.S. patent application Ser. No. 16/434,015, filed on Jun. 6, 2019, entitled "Golf Club Having Striking Face With Supporting Wall," which is a Continuation of U.S. application Ser. No. 15/844,286, filed on Dec. 15, 2017, entitled "Golf Club Having Striking Face With Supporting Wall," now U.S. Pat. No. 10,350,468, issued on Jul. 16, 2019, which is a Continuation-in-Part of U.S. patent application Ser. No. 15/184,688, filed Jun. 16, 2016, entitled "Golf Club Having Double-Walled Striking Face," now U.S. Pat. No. 10,065,088, issued on Sep. 4, 2018, the disclosures of which are hereby incorporated by reference herein in its entirety.

BACKGROUND

It is a goal for golfers to reduce the total number of swings needed to complete a round of golf, thus reducing their total score. To achieve that goal, golfers may often desire to hit a golf ball a long distance. The distance the golf ball travels depends on both the skill of the golfer and the equipment used by the golfer. With respect to the golf club, the construction of a striking face, along with other elements of the club, has an effect on the outgoing speed of a ball when struck by the club. For example, as the striking face contacts the golf ball, the striking face may provide a spring-like effect, adding to the speed of the golf ball as it leaves the club face.

SUMMARY

In one aspect, the technology relates to a golf club head having a striking face; a club head body having a perimeter contact rim and a ledge extending from the perimeter contact rim, wherein the striking face is secured to the club head body proximate the perimeter contact rim, and wherein the ledge is spaced from a rear surface of the striking face so as to define a gap therebetween; and an inner wall has a perimeter edge, wherein at least a portion of the perimeter edge is disposed in the gap and in contact with the ledge, and wherein the rear surface of the striking face is in contact with a portion of the inner wall. In an example, the ledge extends inward from the perimeter contact rim, and wherein the ledge is offset from the perimeter contact rim, and wherein the inner wall is substantially parallel to the striking face. In another example, the perimeter edge is tapered. In yet another example, the club head body further includes a sole, a topline, a heel, and a toe, and wherein the ledge is disposed proximate at least one of the sole, the topline, the heel, and the toe. In still another example, the perimeter edge is in contact with a portion of the ledge disposed proximate the topline and the sole.

In another example of the above aspect, a heel portion of the perimeter edge is unsupported by the ledge when the striking face is in a neutral position. In an example, the heel portion of the perimeter edge is in contact with a lip when the striking face is in a deflected position. In another example, the perimeter edge of the inner wall has a shape substantially similar to a perimeter edge of the striking face.

In another aspect, the technology relates to a golf club head having: a body portion having a perimeter contact rim and a ledge extending inward from the at least a portion of the perimeter contact rim, wherein the ledge is discrete from the perimeter contact rim; an inner plate having an edge and a central portion, wherein at least a portion of the edge is in contact with the ledge; and a striking face secured to the perimeter contact rim, wherein a rear surface of the striking face is in contact with the central portion of the inner plate when the striking face is in a neutral position. In an example, the rear surface of the striking face is in contact with the central portion of the inner plate when the striking surface is in a deflected position. In another example, the edge of the inner plate is tapered and wherein when in the deflected position, the rear surface of the striking face and the perimeter edge of the inner plate define a space therebetween. In yet another example, the inner plate includes a topline edge, a sole edge, and a heel edge, and wherein when the striking surface is in a neutral position, the topline edge and the sole edge are in contact with the ledge. In still another example, when the striking surface is in a deflected position, (a) the topline edge and the sole edge are in contact with the ledge, and (b) the heel edge is in contact with a lip extending from the club head body.

In another example of the above aspect, the striking face is secured about the perimeter contact rim. In an example, the body portion includes a topline edge, a sole edge, a heel edge, and a toe edge, and wherein the ledge extends along substantially the entire length of at least one of the topline edge, the sole edge, the heel edge, and the toe edge. In another example, the ledge has two ledges, wherein the two ledges are disposed proximate opposing edges of the perimeter contact rim.

In another aspect, the technology relates to a golf club head having: a club head body having a perimeter contact rim and a ledge extending inward from at least two opposing edges of the perimeter contact rim; a striking face connected to the club head body proximate the perimeter contact rim; and an inner wall having a central portion defining a central area and an edge surrounding the central portion and defining an edge area less than the central area, wherein the edge is in contact with the ledge, and wherein a rear surface of the striking face contacts the central portion and is spaced apart from the edge when the striking face is in both a neutral position and a deflected position. In an example, a distance between the edge and the rear surface of the striking face in the neutral position is greater than a distance between the edge and the rear surface of the striking face in the deflected position. In another example, the central area includes an area approximately 78% of a total area of the inner wall. In yet another example, the striking face and the inner wall have substantially similar perimeter shapes.

In another aspect, the technology relates to a golf club head including a golf club head body. The golf club head body includes a striking face; a toe portion; a heel portion opposite the toe portion; a sole portion; a topline portion opposite the sole portion; and a ledge extending toward an interior of the golf club head body from the sole portion, the toe portion, and the topline portion. The ledge is not provided in the heel portion. The ledge is spaced apart from a rear surface of the striking face so as to define a gap therebetween. An inner wall including at least one of a composite material, fiberglass, and carbon fiber is in contact with at least a portion of the rear surface of the striking face, and at least a portion of the inner wall is disposed in the gap. A perimeter support member is interposed between the inner wall and the ledge.

In another aspect, the technology relates to a method for manufacturing a golf club head that includes providing a golf club head body comprising a heel portion, a toe portion opposite the heel portion, a sole portion, a topline portion opposite the sole portion, and a striking face, positioning an inner wall within the golf club head body against a rear surface of the striking face such that the inner wall at least partially contacts the rear surface of the striking face, and the inner wall at least partially fills a gap defined between the striking face and a ledge extending toward an interior of the golf club head body from the sole portion, the toe portion, and the topline portion, the ledge not provided in the heel portion; and inserting a perimeter support member between the ledge and the inner wall so as to completely fill the gap.

In another aspect, the technology relates to a golf club head including a striking face; and a golf club head body. The golf club head body includes a contact rim at least partially supporting the striking face, wherein the striking face is secured to the golf club head body proximate the contact rim along at least a sole portion and a topline portion of the golf club head body; an inner wall includes at least one of a composite material, fiberglass, and carbon fiber; and an opening defined in the golf club head body and adapted to receive the inner wall therethrough. A rear surface of the inner wall is supported by the golf club head body and reinforces the striking face, and at least a portion of a front surface of the inner wall is in contact with a rear surface of the striking face.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate a golf club head, such as an iron, fairway metal, driver, or other golf club head, that includes a double-walled striking face, e.g., a golf club head having an inner wall structure in contact with an outer striking face. In examples, such club heads may include a sole channel. One end of the inner wall structure is fixed to the golf club head, while another end of the inner wall structure is unfixed, allowing the inner wall structure to slide against a rear surface of the striking face. Such an inner wall structure contributes to a spring effect of the striking face, thus improving ball speed and launch characteristics from strikes near the center and top of the striking face. The golf club head may also include a sole channel that creates improved ball speed and launch characteristics for strikes near the center and bottom of the striking face. Accordingly, the use of the double-walled striking face and the sole channel in tandem provide improved launch characteristics, such as launch angles, spin characteristics, and ball speed, across the entire striking face, from the topline to the sole. Thus, both shots from the turf and off a tee produce improved launch characteristics.

Figure 1B:
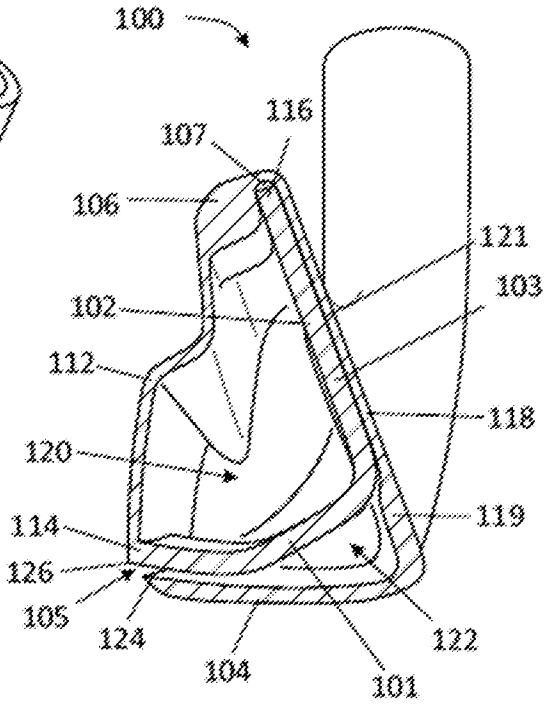
FIG. 1B depicts a section view of an example of a golf club head having a double-walled striking face and a sole channel.
Figure 1A:
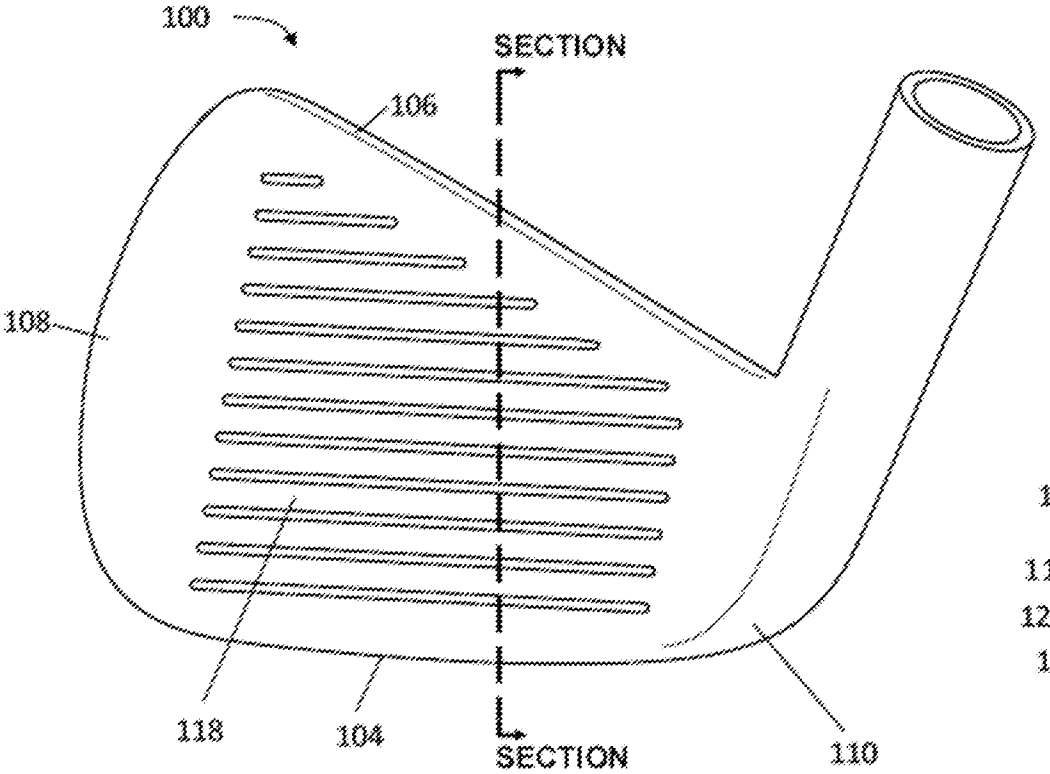
FIG. 1A depicts a perspective view of a golf club.

FIG. 1A depicts a perspective view of a golf club head 100 having an inner wall structure 102 and a sole channel 105, and FIG. 1B depicts a section view of the golf club head 100. FIGS. 1A-1B are described concurrently. The golf club head 100 includes striking face 118 attached to a sole portion 104, a toe portion 108, a topline 106, and a heel portion 110. The topline 106 is also attached to a back portion 112. The inner wall structure 102 extends from the back portion 112 towards the striking face 118, and a first cavity 120 is partially defined (in section) by the back portion 112, the topline 106, and the inner wall structure 102. The inner wall structure 102 includes a fixed end 114, attached to the back portion 112, and an unfixed end 116. The fixed end 114 may be attached to the back portion 112 via welding, brazing, or fastening, such as with screws or rivets, along with any other suitable attachment methods. The unfixed end 116 is received by a recess 107 in an internal portion of the topline 106. The recess 107 is shaped or configured so as to receive, but not fix or secure, the unfixed end 116 of the inner wall structure 102, such that the unfixed end 116 may move freely therefrom. The inner wall structure 102 also includes a support portion 101 and a contact portion 103. The support portion 101 supports the contact portion 103, which is in contact with a rear surface of the striking face 118. In the example depicted, the support portion 101 generally has an angled v-shape from the back portion 112 to the striking face 118, and a component of the support portion 101 extends substantially orthogonal to the striking face 118. The contact portion 103 runs substantially parallel to the striking face 118. Lubrication may be disposed between the contact portion 103 and the striking face 118 so as to reduce the friction between those elements. This allows for easier sliding of the surfaces against one another. Further, in some examples, additional machining or processing is performed on these contacting elements to create extra-smooth surfaces to further reduce friction therebetween. The contact portion 103 may also be coated with a polymer, such as a TEFLON-brand coating available from E. I. duPont de Nemours and Company of Wilmington, Del., or other similar materials for management of vibrations, friction, and alteration of sound properties emitted upon striking a golf ball.

The striking face 118 may also have multiple thicknesses, including a thick portion 119 and a thin portion 121. The thick portion 119 has a thickness greater than a thickness of the thin portion 121. Because the inner wall structure 102 provides additional support to the thin portion 121, the thin portion 121 may be thinner than it would otherwise be in the absence of the inner wall structure 102. In an example, the thick portion 119 has a thickness that is approximately double the thickness of the thin portion 121. In one example, the thin portion 121 may have a thickness of approximately 0.9 mm and the thick portion 119 may have a thickness of approximately 1.4 mm.

The thickness of the contact portion 103 and the thin portion 121 of the striking face 118 may also differ. For example, the contact portion 103 may have a thickness that is approximately double the thickness of the thin portion 121 of the striking face 118. In some examples, the ratio of the thickness of the contact portion 103 to the thickness of the thin portion 121 of the striking face 118 may be approximately 1.5:1, 2.5:1, or 3:1. In other examples, the thickness of the contact portion 103 may be approximately the same as that of the thick portion 119 of the striking face 118.

The types of materials used to create the inner wall structure 102 and the striking face 118 may also differ. As an example, the inner wall structure 102 may be made of a low-density material with a high strength, while the striking face 118 may be made of a material with a relatively higher density and a relatively lower strength. As another example, the striking face 118 may be made from a material having a low elastic modulus while the inner wall structure 102 may be made form a material having a relatively higher elastic modulus. For instance, the striking face 118 may be made from a steel material and the inner wall structure 102 may be made from a titanium material. In another instance, the inner wall structure 102 may be made from a high-strength steel, such as maraging C350 steel, and the striking face 118 may be made from a lower strength steel, such as maraging C300 steel. In the above examples using different types of materials, the thickness of the contact portion 103 may be approximately the same as the thickness of the thin portion 121 of the striking face 118. Such materials may also be coated with a polymer for damping vibration and managing friction between surfaces. For instance, the contact portion 103 could be coated with a low-friction polymer.

The golf club head 100 may also include a sole channel 105. The sole channel 105 includes a front edge 124 and a back edge 126. The sole channel 105 may extend from near the heel portion 110 to the toe portion 108 and may be substantially the same width as the striking face 118. In the example depicted, the sole channel 105 separates the back portion 112 from the sole portion 104. The fixed end 114 of the inner wall structure 102 is attached to the back portion 112 at the back edge 126. The sole channel 105 defines a through-hole into a second cavity 122 that is partially defined (in section) by the thick portion 119, the sole portion 104, and the inner wall structure 102. In some examples, the sole channel 105 is filled with or spanned by a polymer or other elastic material to prevent debris from entering the second cavity 122. The incorporation of the sole channel 105 allows for further deflection of lower portions of the striking face 118, thus providing additional ball speed from golf ball strikes occurring in lower regions of the striking face 118.

Figure 1D:
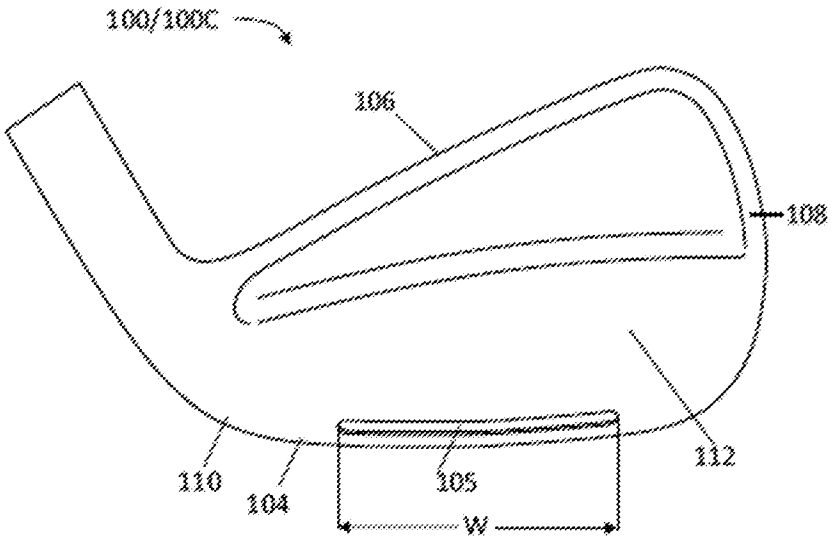
FIG. 1D depicts a back view of the golf club head depicted in FIGS. 1A-1C.
Figure 1C:
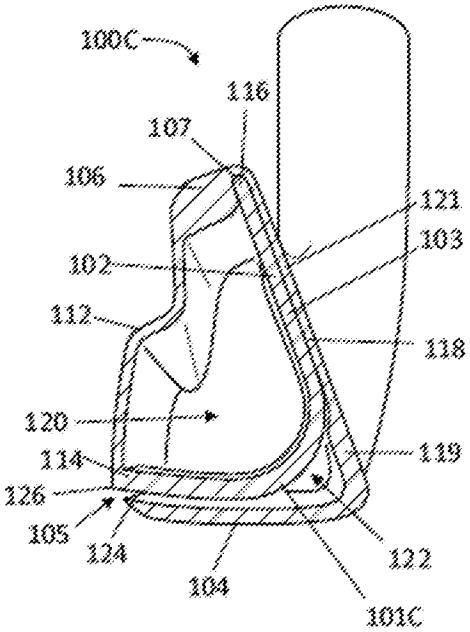
FIG. 1C depicts a section view of another example of a golf club head having a double-walled striking face and a sole channel.

FIG. 1C depicts a section view of another example of a golf club head 100C having an inner wall structure 102 and a sole channel 105. The golf club head 100C is substantially the same as the golf club head 100 depicted in FIG. 1B and, as such, not all element thereof are described further. In golf club head 100C, however, the support portion 101C has a curved C-shape. The curved C-shape of support portion 101C allows for more deflection of the striking face 118 and the contact portion 103 because the component of the curved C-shape that is orthogonal to the striking face 118 is reduced in size.

FIG. 1D depicts a back view of the golf club heads 100, 100C depicted in FIGS. 1A-1C. The sole channel 105 runs across a bottom side of the back portion 112 in a direction substantially parallel to the striking face 118. In the example depicted, the sole channel 105 separates a portion of the sole portion 104 from the back portion 112. In some embodiments, the sole channel 105 may have a width W that is approximately the same as the width of the striking face 118 and/or the width of the inner wall structure 102. In other examples, the width W of the sole channel 105 is approximately the same as the diameter of a golf ball (i.e., about 1.6-1.7 inches) or greater. As discussed above, the sole channel 105 may also be filled with or spanned by an elastic material.

Figure 2A:
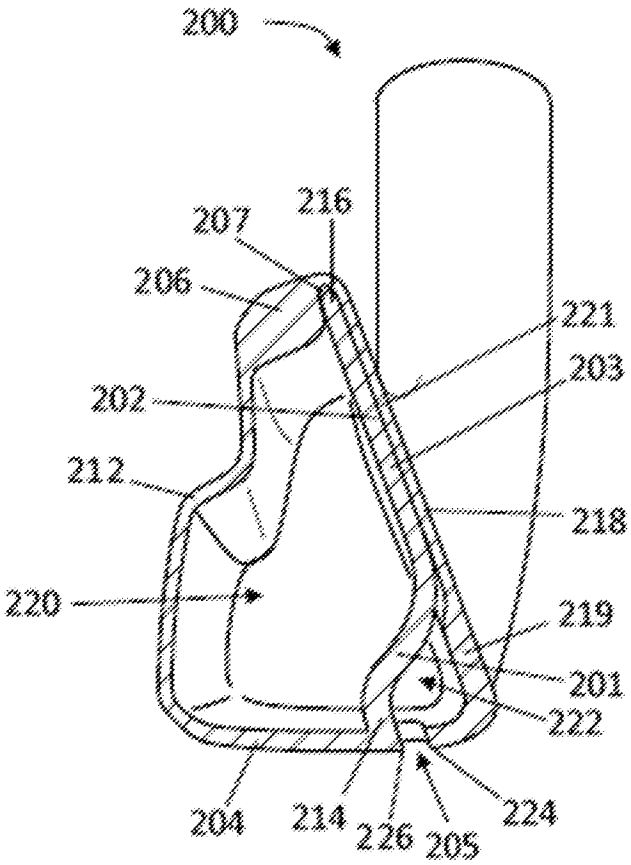
FIG. 2A depicts a section view of another example of a golf club head having a double-walled striking face and a sole channel.
Figure 2B:
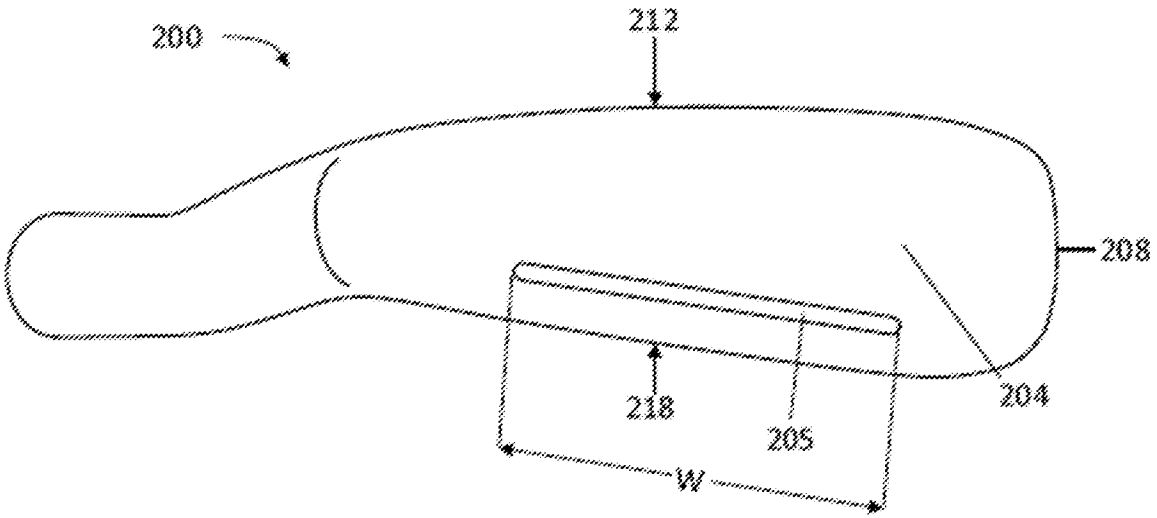
FIG. 2B depicts a bottom view of the golf club head of FIG. 2A.

FIGS. 2A-2B depict a section view and a bottom view, respectively, of another golf club head 200 and are described concurrently. The golf club head 200 is similar to the golf club heads 100, 100C depicted in FIGS. 1A-1C and described above. As such, elements common to both configurations are numbered similarly, but are not necessarily described further. An inner wall structure 202 includes a support portion 201, a contact portion 203, a fixed end 214, and an unfixed end 216. The support portion 201 has a curved S-shape and the contact portion 203 is substantially parallel to the striking face 218. The striking face 218 may also include a thick portion 219 and a thin portion 221. Two cavities are also formed: a first cavity 220 and a second cavity 222.

The sole channel 205 is located proximate to the striking face 218. By moving the sole channel 205 closer to the striking face 218, the deflection of the thick portion 219 of the striking face 218 is increased when striking a golf ball. The back edge 226 of the sole channel 205 is formed by a rear segment of the sole portion 204 and the front edge 224 of the sole channel 205 is formed by a front segment of the sole portion 204. Because less of the sole portion 204 is directly attached to the striking face 218, there is less resistance to deflection of the thick portion 219. Accordingly, the increased deflection may provide for increased ball speeds resulting from ball strikes occurring near the thick portion 219 of the striking face 218. The sole channel 205 may also run substantially parallel to the striking face 218, as shown in FIG. 2B. The sole channel 205 may also be filled with or spanned by an elastic material.

Figure 3:
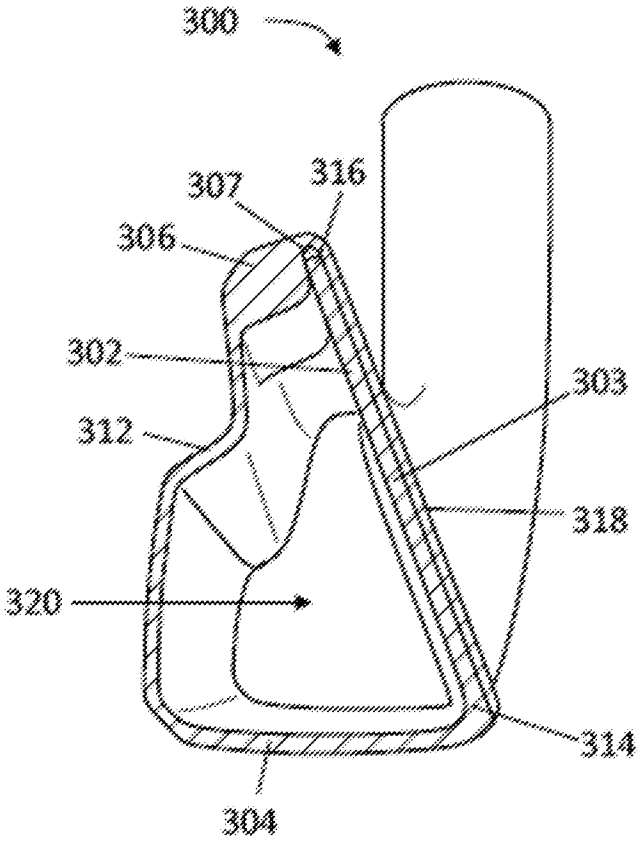
FIG. 3 depicts a section view of another example of a golf club head having a double-walled striking face.

FIG. 3 depicts another example of a golf club head 300. The golf club head 300 is similar to golf club heads described above, and as such, elements common to those configurations and the golf club head 300 are numbered similarly, but are not necessarily described further. The golf club head 300 includes a striking face 318 that is attached to the topline 306, the toe portion 308 and the heel portion 310, but is at least partially not attached to the sole portion 304. Accordingly, the striking face 318 is effectively hinged at the topline 306 allowing for movement of the striking face 318. In other embodiments, the striking face 318 may also not be directly attached to the toe portion 308 or the heel portion 310.

The inner wall structure 302 includes a fixed end 314 and an unfixed end 316. The fixed end 314 is attached to a front edge of the sole portion 304 directly behind the striking face 318. The inner wall structure 302 may not include a support portion, as the entire inner wall structure 302 is in contact with the rear surface of the striking face 318. In some examples, however, the inner wall structure 302 may include a small support portion to allow for attachment to the sole portion 304 via welding or other fastening measures. Unlike the embodiments depicted above, only a single cavity 320 is present.

The inner wall structure 302 and the striking face 318 are fixed, or effectively hinged, at opposite portions of the golf club head 300. More specifically, in the example depicted, the inner wall structure 302 has a fixed end 314 at the sole portion 304 and an unfixed end 316 near the topline 306, and the striking face 318 has a fixed end at the topline 306 and an unfixed end near the sole portion 304. Such a configuration allows the inner wall structure 302 to slide against the rear surface of the striking face 318 and also to deflect separately from the striking face 318. For example, upon a strike of a golf ball, the striking face 318 moves in an upward direction while the inner wall structure 302 moves downward.

In other examples, the fixed and unfixed ends of the inner wall structure 302 and the striking face 318 may be inverted from the example depicted in FIG. 3. That is, the inner wall structure 302 may have a fixed end at the topline 306 and an unfixed end near the sole portion 304, and the striking face 318 may have a fixed end at the sole portion 304 and an unfixed end near the topline 306. In yet other examples, the inner wall structure 302 may have a fixed end at the toe portion 308 and an unfixed end near the heel portion 310, and the striking face 318 may have a fixed end at the heel portion 310 and an unfixed end near the toe portion 308, or vice versa.

Further, because substantially the entire rear surface of the striking face 318 is in contact with the inner wall structure 302, the thickness of the striking face 318 may be uniform. The thickness of the striking face 318 may also be less than the thickness of the inner wall structure 302, and the striking face 318 and the interior wall structure 302 may also be made of different materials.

Figure 4A:
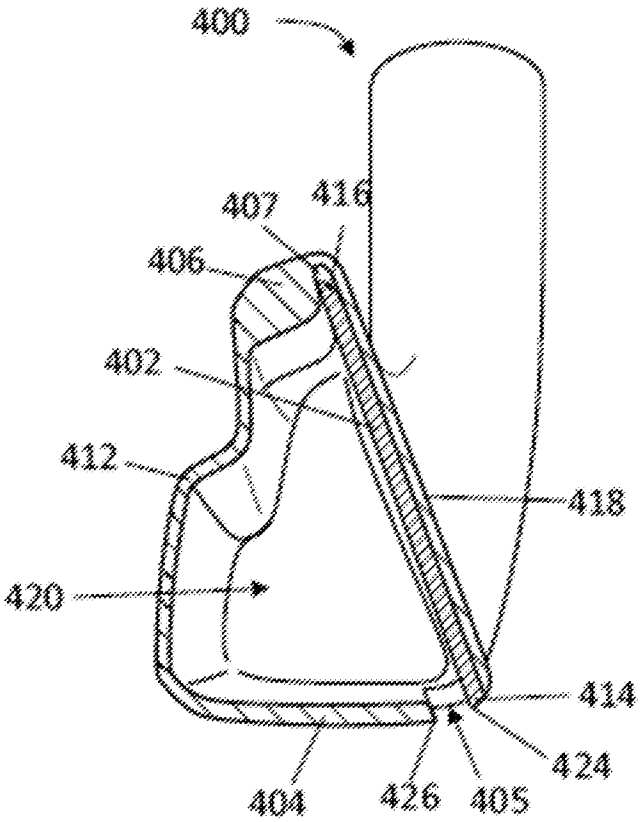
FIG. 4A depicts a section view of another example of a golf club head having a double-walled striking face and a sole channel.
Figure 4B:
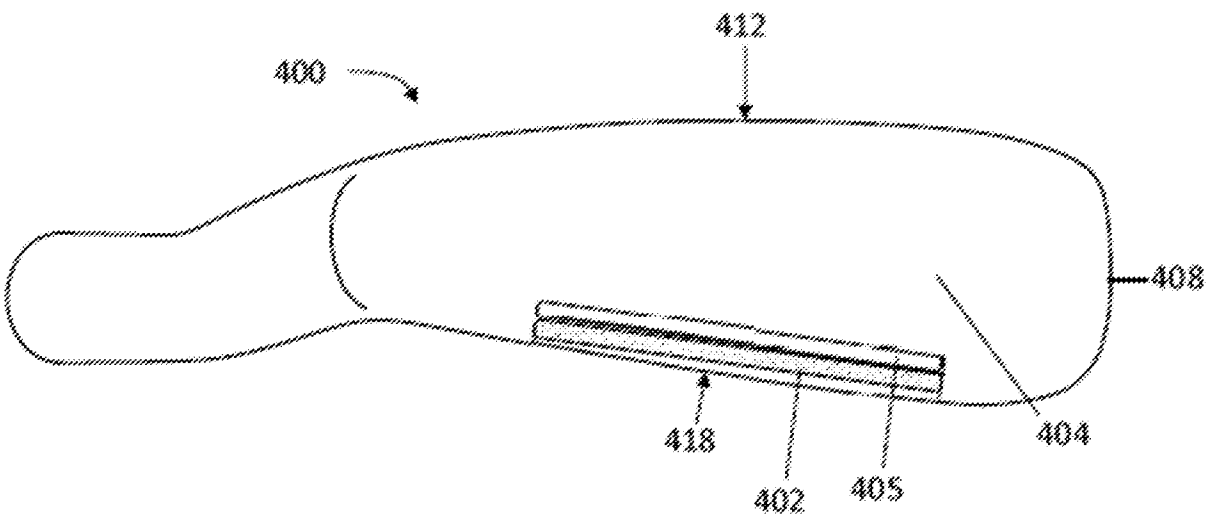
FIG. 4B depicts a bottom view of the golf club head of FIG. 4A.

FIGS. 4A-4B depict a section view and a bottom view, respectively, of another golf club head 400 and are described concurrently. The golf club head 400 is similar to the golf club heads described above. As such, elements common to the configuration of the golf club head 400 and the golf club heads described above are numbered similarly, but are not necessarily described further. The inner wall structure 402 of the golf club head 400 includes a fixed end 414 and an unfixed end 416. The fixed end 414 may be attached to the sole portion 404, toe portion 408, and/or the heel portion 410, and the unfixed end 416 is received in a recess 407 in the interior portion of the topline 406. In some embodiments, the inner wall structure 402 may be wider than the sole channel 405, and the fixed end 414 of the inner wall structure 402 may be attached to segments of the sole portion 404 that extend outside the sole channel 405 towards the toe portion 408 and the heel portion 410. The striking face 418 has a fixed end at the topline 406 and an unfixed end near the sole portion 404. Accordingly, the inner wall structure 402 may slide against the rear surface of the striking face 418. In some examples, the striking face 418 may also be attached to the toe portion 408 and/or the heel portion 410.

The sole channel 405 is located near the front of the golf club head 400 and separates the inner wall structure 402 and the striking face 418 from the remainder of the sole portion 404. For instance, the front edge 424 of the sole channel 405 is defined by the fixed end 414 of the inner wall structure 402, and the back edge 426 is defined the sole portion 404. By locating the sole channel 405 further towards the front of the golf club head 400, the bottom portion of the striking face 418 is able to more easily deflect, further adding to the ball speed resulting from a strike on the lower portion of the striking face 418. The sole channel 405 may also be filled with or spanned by an elastic material. In some embodiments, a flexible coating may also coat the bottom of the golf club head 400 to cover the edges of the striking face 418 and any external edges of the inner wall structure 402, e.g., so as to prevent wear.

Figure 5A:
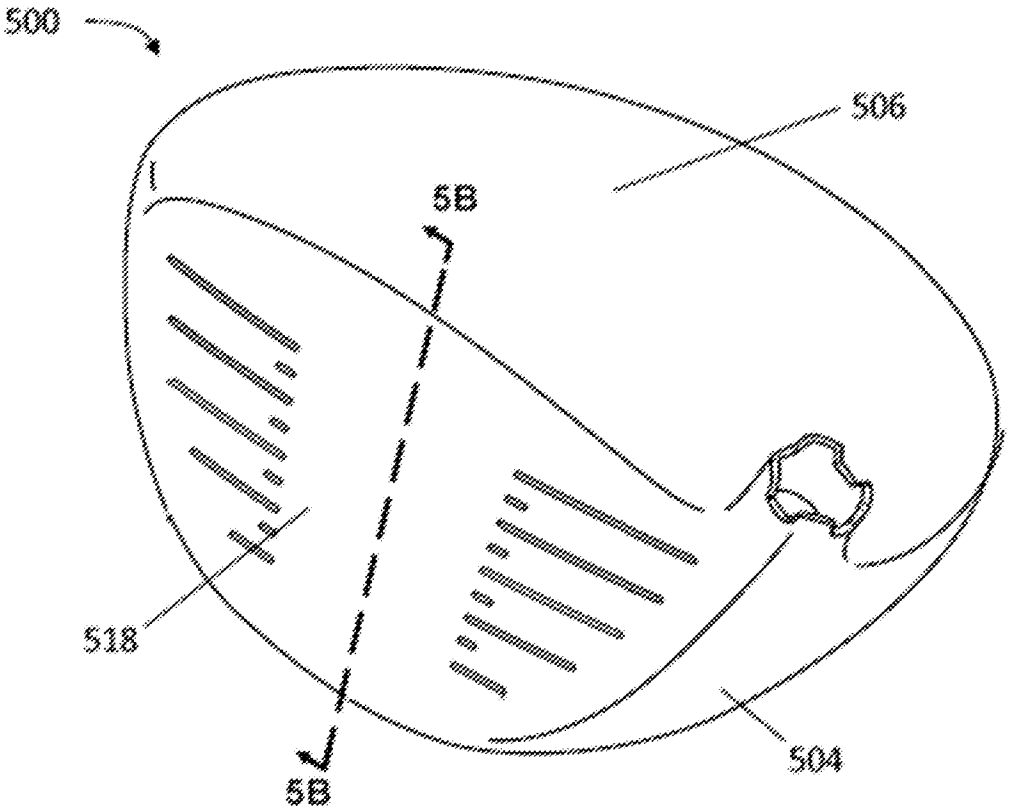
FIG. 5A depicts a perspective view of a golf club head of a driver having a double-walled striking face and a sole channel.
Figure 5B:
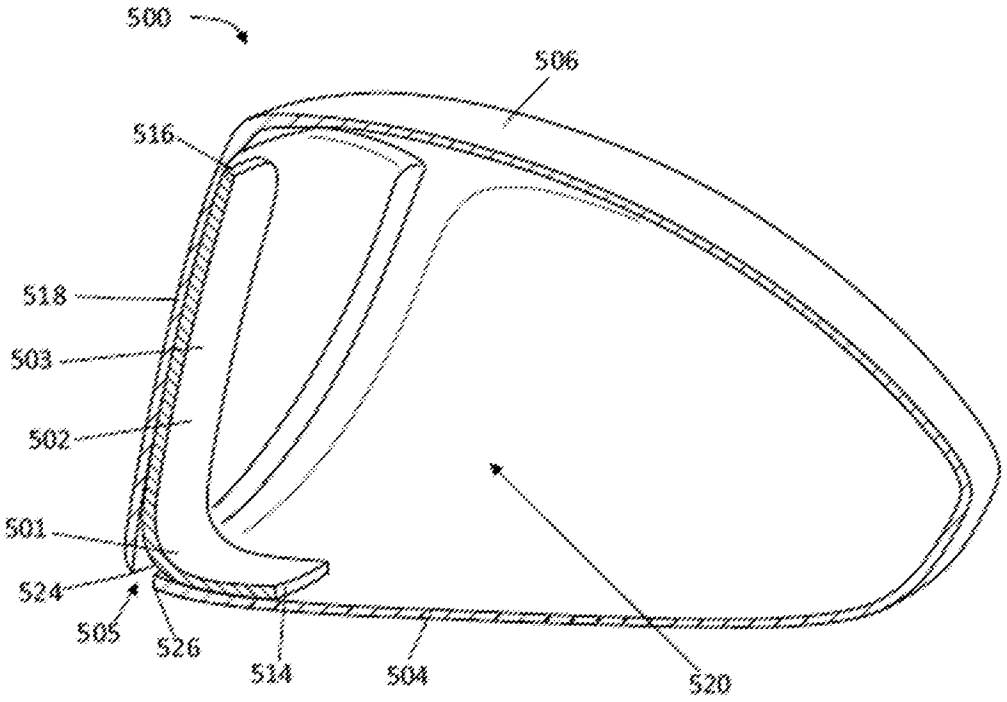
FIG. 5B depicts a section view of the golf club head of FIG. 5A.
Figure 5C:
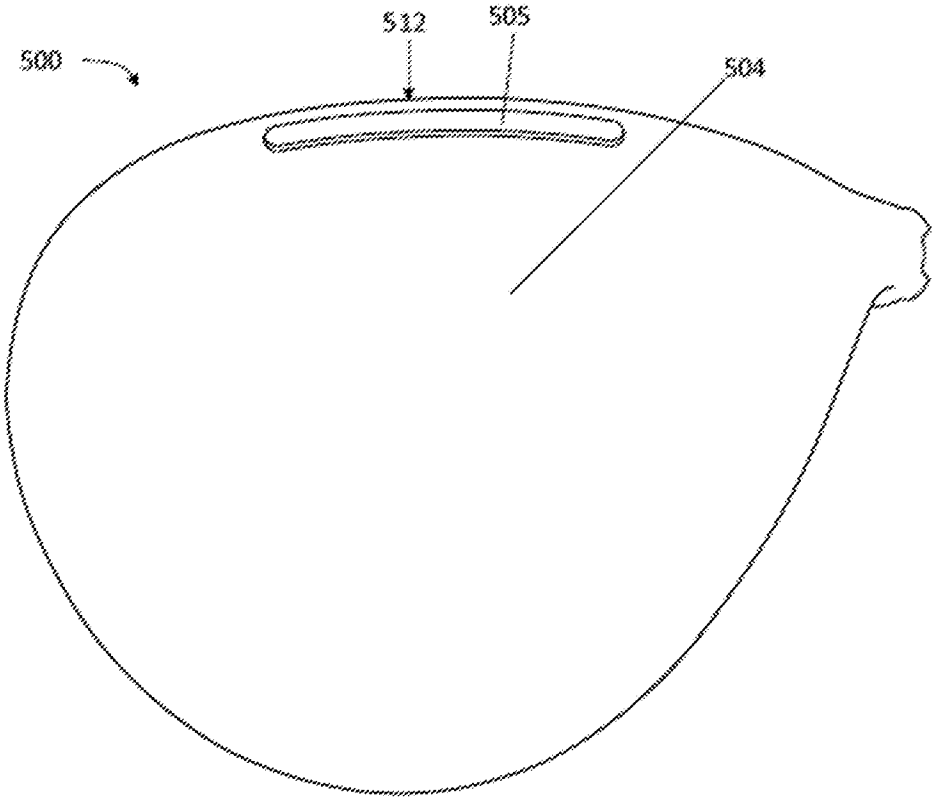
FIG. 5C depicts a bottom view of the golf club head of FIGS. 5A-5B.

FIG. 5A depicts a perspective view of a golf club head 500 of a driver having an inner wall structure 502 and a sole channel 505. FIG. 5B depicts a section view of the golf club head 500, and FIG. 5C depicts a bottom view of the golf club head 500. FIGS. 5A-5C are described concurrently. The golf club head 500 includes a crown 506 and a sole portion 504 attached thereto. The golf club head 500 also includes a striking face 518 attached to the crown 506 and a segment of the sole portion 504. The inner wall structure 502 includes a fixed end 514 attached to the sole portion 504 near the back edge 526 of the sole channel 505. An unfixed end 516 is not fixed to the striking face 518 or the crown 506. In some embodiments, the crown 506 may include a recess (not shown) for receiving the unfixed end 516 of the inner wall structure 502 as with the configurations described above. The inner wall structure 502 also includes a support portion 501 and a contact portion 503. The support portion 501 may be a curved c-shape, a curved s-shape, or some other shape. The contact portion 503 may contact the majority of the rear surface of the striking face 518. In some examples, substantially the entire rear surface of the striking face 518 is backed by the inner wall structure 502. In some embodiments, the striking face 518 and the inner wall structure may be constructed of the same or similar materials as discussed above. Further, the contact portion 103 may be coated with a polymer for managing vibration, sounds properties, and to reduce friction. The golf club head 500 also includes a cavity 520 partially defined (in section) by the sole portion 504, the crown 506, and the inner wall structure 502.

The sole channel 505 is incorporated into the sole portion 504. In the example depicted, the front edge 524 of the sole channel 505 is defined by a bottom edge of the striking face 518, and the back edge 526 of the sole channel 505 is defined by the sole portion 504. Accordingly, the sole channel 505 separates a portion of the striking face 518 from the sole portion 504. The sole channel 505 may have a width substantially the size of a golf ball diameter or larger. In some examples, the sole channel 505 may have a width more than double the size of a golf ball diameter. Many of the benefits and features from the sole channels and inner wall structures discussed above are also applicable to the golf club head 500. Further, while sole channel 505 and the inner wall structure 502 are shown in the golf club head 500 of a driver, such structures may be incorporated into other metal woods, such as fairway metal woods and hybrid clubs.

Figure 6:
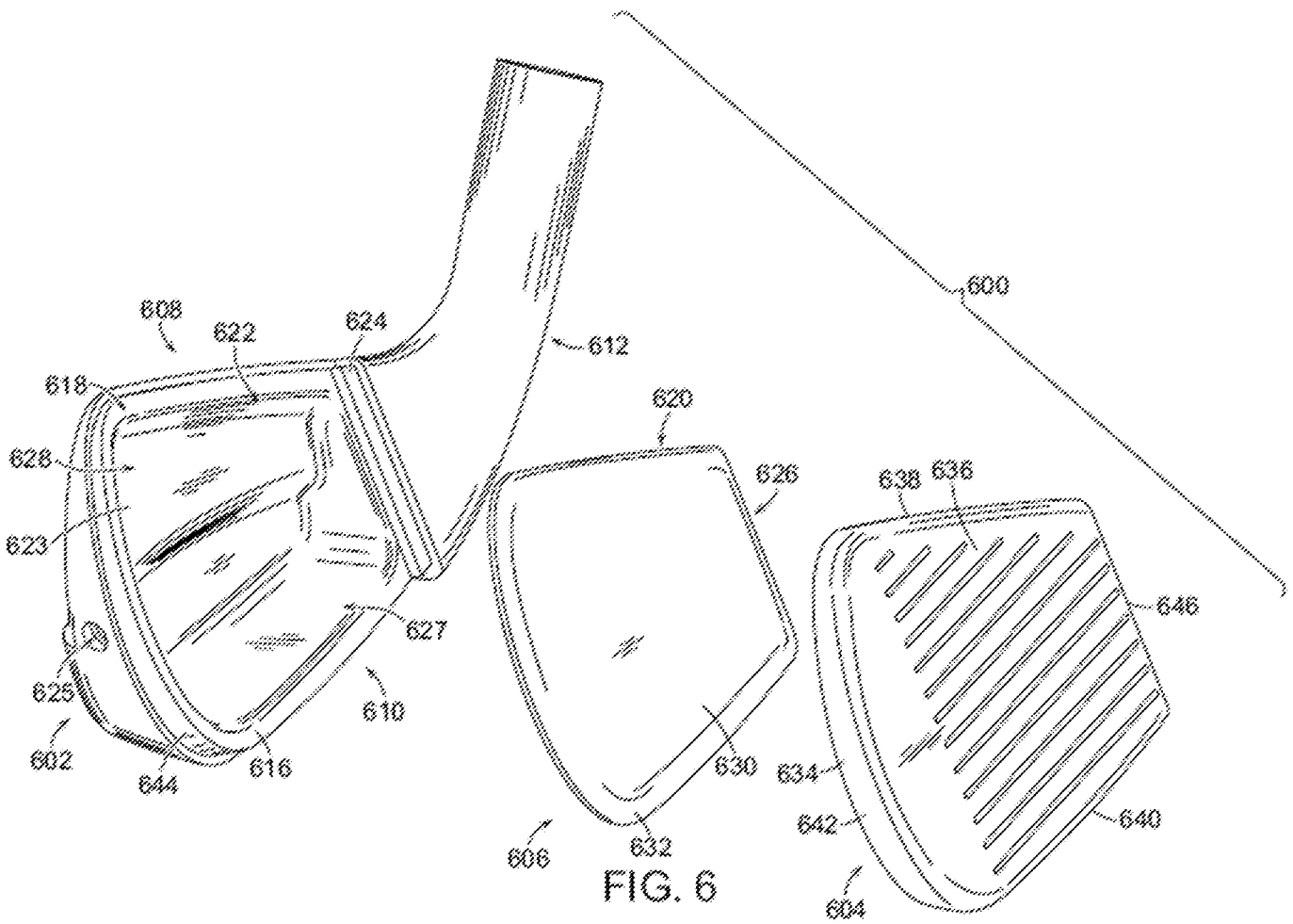
FIG. 6 depicts an exploded perspective view of another example of a golf club head having a back supporting wall.

FIG. 6 depicts an exploded perspective view of another example of a golf club head 600. The golf club head includes a club head body 602, a striking face 604, and an inner wall 606 disposed between the body 602 and striking face 604, as described in more detail herein. The club head body 602 includes a perimeter defined by a topline 608, a sole 610, a heel 612, and a toe 614, as known generally in the art. Further, each of the striking face 604 and inner wall 606 include edges or portions disposed proximate each of the corresponding portions 608, 610, 612, and 614 of the club head body 602. The body 602 includes a ledge 616 that extends inward from the outer perimeter of the body 602. The ledge 616 provides support along one or more edges of the inner wall 606. In the depicted configuration, the ledge 616 is proximate but discrete from the topline 608, sole 610, and toe 614 of the club body 602. In other examples the ledge 616 may extend from each of the topline 608, sole 610, heel 612, and toe 614. In other example, the ledge 616 may extend from only two of those features, which may be generally opposed to each other. The ledge 616 includes a flat, or generally flat, contact surface 618 that contacts a rear surface the inner wall 606, typically proximate an outer perimeter edge 620 thereof. The ledge 616 may also include a curved edge portion 622, which reduces stress on the inner wall 606 as the inner wall 606 deflects during use. The club body 602 may include a rest 624 which may be a raised wall or other feature that may be used to assist in manufacture. For example, a heel edge 626 of the inner wall 606 may be placed in abutting contact with the rest 624 during manufacture to ensure proper positioning thereof. Thereafter, the striking face 604 may be secured to the club body 602 so as to hold the inner wall 606 therein. The topline 608, sole 610, heel 612, toe 614, inner wall 606, and a rear wall 623 may define a void 627 within the golf club head 600. As the inner wall 606 deflects into the void 627 during use, pressure in the void 627 may increase. A pressure relief 625 may be defined by a portion of the club head body 602 and may be covered by a thin flexible film or other membrane to prevent ingress of water or debris, while accommodating pressure changes within the void 627.

The inner wall 606 may be a thin plate, manufactured, for example, of high-strength steel and steel alloys. Example materials include Aermet 320, Aermet 340, and others. The inner wall 606 may have an outer perimeter shape substantially similar to that of the club head body 602 (more specifically, an opening 628 defined generally by the ledge 616 therein), and/or the striking face 604. The inner wall 606 has a central area 630 and an edge area 632 that bounds the central area 630, which is generally flat. The edge area 632 is tapered, such that the outer perimeter edge 620 of the inner wall 606 has a thickness less than that of the central area 630. In examples, the central area 630 may have a thickness of between about 1.75 mm to about 1.35 mm. Central area 630 thicknesses of about 1.75 mm, about 1.65 mm, or about 1.5 mm may be desirable, although other thicknesses are contemplated. The thickness of the inner wall 606 at the outer perimeter edge 620 may be between about 1.35 mm to about 0.8 mm. Perimeter edge 620 thicknesses may be about 1.3 mm, about 1.2 mm, or about 1.05 mm. Of course, the thickness at the outer perimeter edge 620 is less than that at the central portion 630. The tapered edge area 632 allows the inner wall 606 to deflect during striking of a golf ball, without applying a force to the striking face 604, thus preventing inadvertent separation thereof from the club body 602. This is depicted in more detail below in FIGS. 10A and 10B.

Relative sizes of the central area 630 and the edge area 632 of the inner wall 606 may be modified as required or desired to affect performance of the golf club head 600. The central area 630 may be defined as the area of the inner wall 606 that contacts a rear surface of the striking face 604 when the golf club head 600 is in the neutral position. The edge area 632 may be defined as the area of the inner wall 606 that does not contact the rear surface of the striking face 604 when the golf club head 600 is in the neutral position. In examples, the central area 630 may represent about 75%, about 78% or about 80% of the total area of a front face of the inner wall 606 (with the edge area representing about 25%, about 22%, and about 20%, respectively, thereof). In general, the larger the central area 630 of the inner wall 606, the greater return force on the striking face 604 during deflection thereof.

The striking face 604 may also be generally flat, but also may include a rim 634 that may extend at least partially around a striking portion 636 of the striking face 604. In this case, the rim 634 is disposed along a topline edge 638, a sole edge 640, and a toe edge 642 of the striking face 604. These edges 638, 640, 642 are secured to a contact rim 644 on the club body 602, so as to secure the striking face 604 to the club body 602. The striking face 604 may be secured to the contact rim 644 via welding, chemical adhesive(s), friction interface(s), etc. In this example, a heel edge 646 of the striking face 604 does not include any portion of the rim 634 and, as such, may be secured to the flat rest 624. The ledge 616 may be generally discrete and extend inward from the contact rim 644. The striking face 604 may have a thickness of about 0.9 mm to about 1.25 mm.

Certain thickness relationships between the striking face 604 and inner wall 606 may produce particularly desirable results. Example thicknesses of each of these components are identified above. For example, it has been determined that particularly desirable models include a ratio of inner wall thickness to the front wall thickness of between about 1.2 and about 1.5. In one particular example, the inner wall 604 has a thickness of about 1.5 mm, while the front wall has a thickness of about 1.25 mm.

Figure 7:
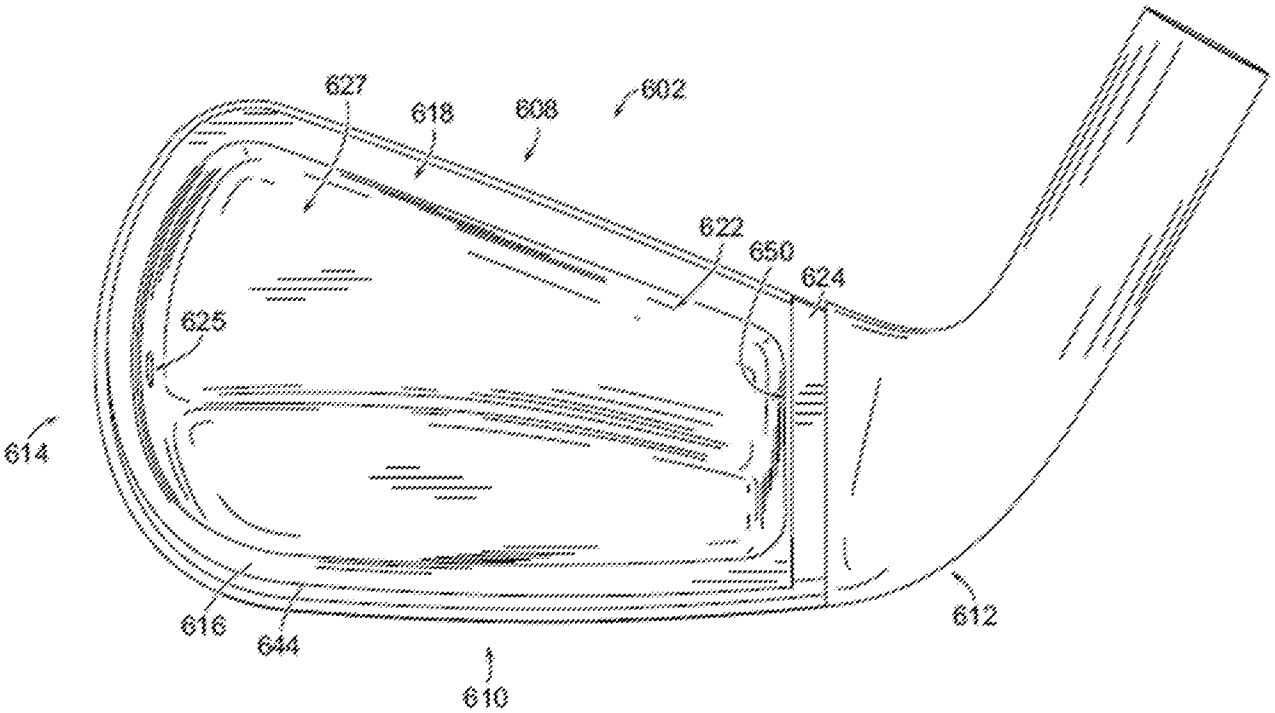
FIG. 7 depicts a front view of the club head body of FIG. 6.

FIG. 7 depicts a front view of the club head body 602 of FIG. 6. A number of features depicted in FIG. 7 are described above in the context of FIG. 6 and, as such, are not necessarily described further. As noted above, the club body 602 includes the ledge 616 that terminates at the curved edge portion 622. The depicted club body 602 includes the ledge 616 proximate each of the topline 608, sole 610, and toe 614. As such, the inner wall (not depicted) is disposed in contact with each of these portions of the ledge 616 (that is, proximate the topline 608, sole 610, and toe 614) when the inner wall is in a neutral (or not deflected) position. As the inner wall deflects into the void 627, the rear surface of the edge thereof contacts the curved edge portion 622. The portion of the inner wall proximate the heel 612 of the club body 602 performs differently, however. As can be seen in FIG. 7, the ledge 616 does not extend proximate the heel 612. As such, the rear surface of the inner wall proximate the heel 612 is unsupported by the ledge 616 when in the neutral (or not deflected) position. As the inner wall deflects, however, the rear surface of the inner wall proximate the heel 612 contacts a lip 650 that extends inward from the heel 612. The lip 650 may be generally continuous with the curved edge portion 622 of the ledge 618. Contact between the rear surface of the inner wall and the lip 650 improves performance of the golf club head. It has been discovered through testing that supporting inner wall about the entire perimeter thereof does not necessarily improve performance of the golf club head. In fact, performance may be significantly improved where the inner wall 606 is supported in the neutral position at the edges disposed proximate the topline 608, sole 610, and toe 614, but not at the heel 612.

Figure 8:
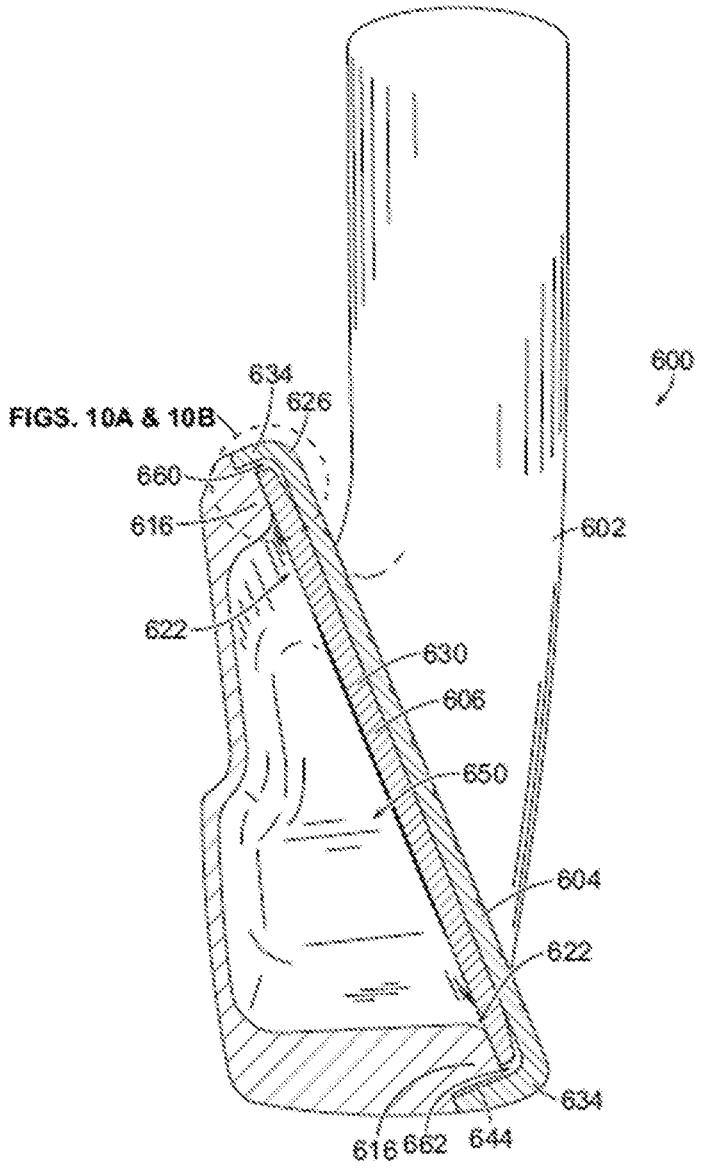
FIG. 8 is a side section view of the golf club head of FIG. 6.

FIG. 8 is a side section view of the golf club head 600 of FIG. 6. A number of features depicted in FIG. 8 are described above in the context of FIGS. 6 and 7 and, as such, are not necessarily described further. When the rim 634 of the striking face 604 is secured to the contact rim 644 of the club head body 602, a gap 660 is formed between the ledge 616 and a rear surface 662 of the striking face 604. The tapered edge area 632 is disposed within this gap 660. When in this configuration, the central area 630 of the inner wall 606 is in contact with the rear surface 662 of the striking face 604. As can be seen in FIG. 8, a front surface of the tapered edge area 632 does not contact the rear surface 662 when in the neutral position. Further, due to the presence of the taper, when the inner wall 606 is in the deflected position (e.g., when the striking face 604 strikes a golf ball and deflects both the striking face 604 and inner wall 606), the tapered outer edge 632 will not apply a responsive force to the rear surface 662 as the edge 632 deflects forward. This is further depicted in FIGS. 10A and 10B, below.

Figure 9:
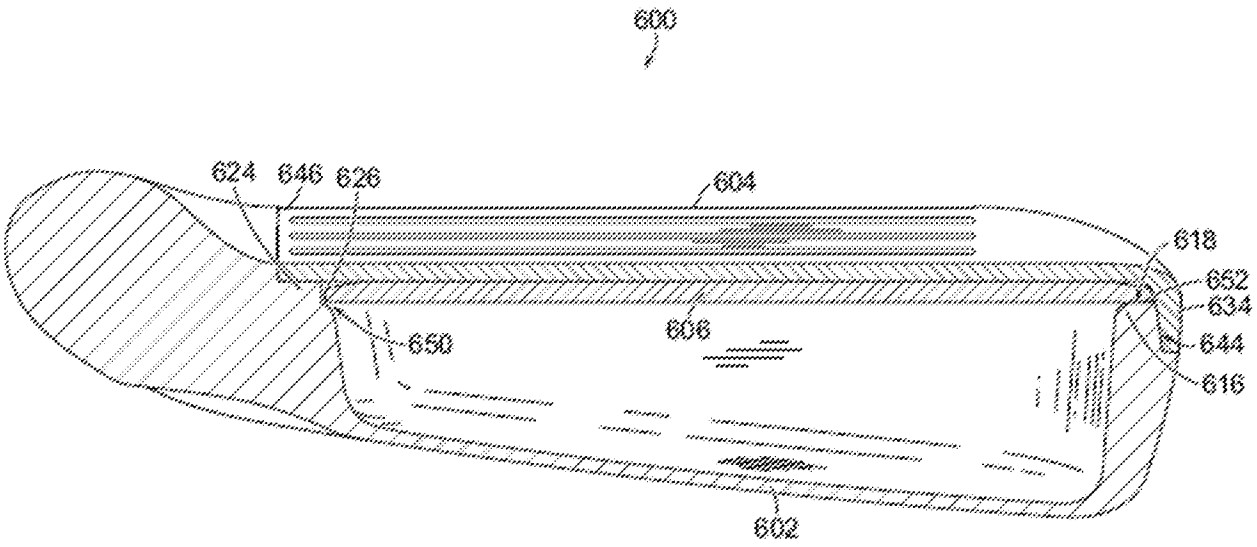
FIG. 9 is a top section view of the golf club head of FIG. 6.

FIG. 9 is a top section view of the golf club head 600 of FIG. 6. A number of features depicted in FIG. 9 are described above in the context of FIGS. 6-8 and, as such, are not necessarily described further. Notably, FIG. 9 depicts the rest 624 which abuts, on a first side, the heel edge 626 of the inner wall 606 and, on a second side, the heel edge 646 of the striking face 604. Further, the lip 650 at the heel edge 626 of the inner wall 606 is depicted. As can be seen, the lip 650 defines a projection considerably less deep than the ledge contact surface 618 disposed on the opposite side of the club body 602. As such, deflection of the heel edge 626 of the inner wall 606 differs from that of the toe edge 652 of the inner wall 606. In that case, varied depths of the ledge 616 may alter performance of a golf club head 600 that utilizes an inner wall 606. In cases, ledges 616 having longer or shorter contact surfaces 618 may be utilized as required or desired for particular applications.

Figure 10A:
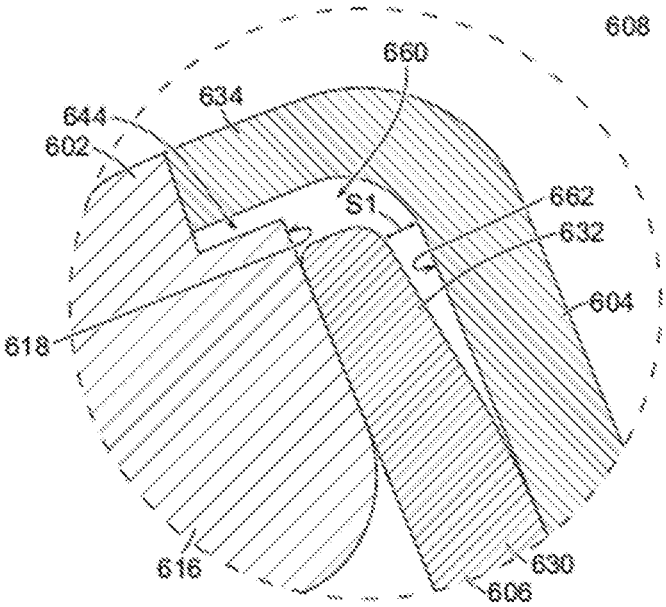
FIGS. 10A and 10B are enlarged partial side section views of the golf club head of FIG. 6 in neutral and deflected positions, respectively.
Figure 10B:
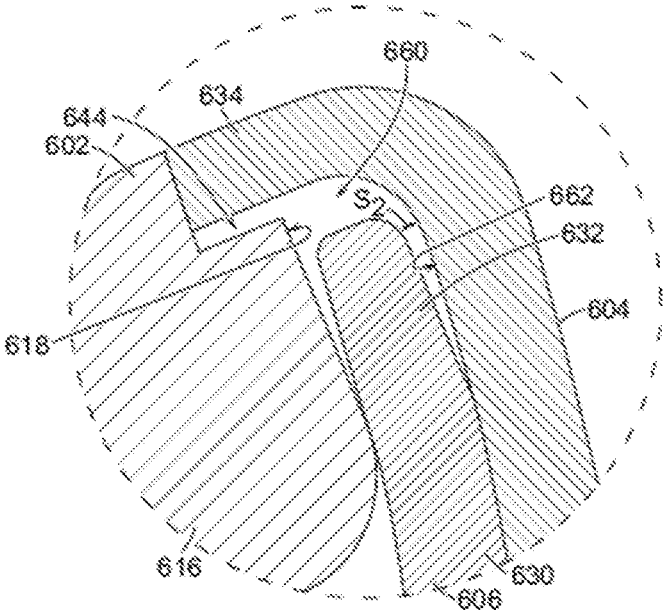

FIGS. 10A and 10B are enlarged partial side section views of the golf club head 600 of FIG. 6 in neutral and deflected positions, respectively. In FIG. 10A, the tapered edge area 632 is depicted in the gap 660 between the rear surface 662 of the striking face 604 and the contact surface 618 of the ledge 616. In the depicted configuration, the rim 634 of the striking face 604 is secured to the contact rim 644 of the club head body 602. The central area 630 of the inner wall 606 is in contact with the rear surface 662 of the striking face 604. In the neutral position, the taper of the edge area 632 defines a first space S1 between the tapered edge surface 632 and the rear surface 662 of the striking face 604. Turning to FIG. 10B, deflection of the striking face 604, e.g., due to contact with a golf ball, is depicted. Since the rear surface 662 of the striking face 604 is in contact with the central portion 630 of the inner wall 604, deflection thereof also deflects the inner wall 604. In response, the tapered edge area 632 disposed about the perimeter of the inner wall 606 deflects forward, towards the rear surface 662 of the striking face 604. This decreases the distance between the tapered edge surface 632 and the rear surface 662 to a space S2, which is less than S1. However, due to the shape of the tapered edge area 632, contact with the rear surface 662 is reduced or eliminated. This prevents application of a force against the rear surface 662, which may help preserve the integrity of the connection between the rim 634 of the striking face 604 and the contact rim 644 of the club head body 602.

Figure 11:
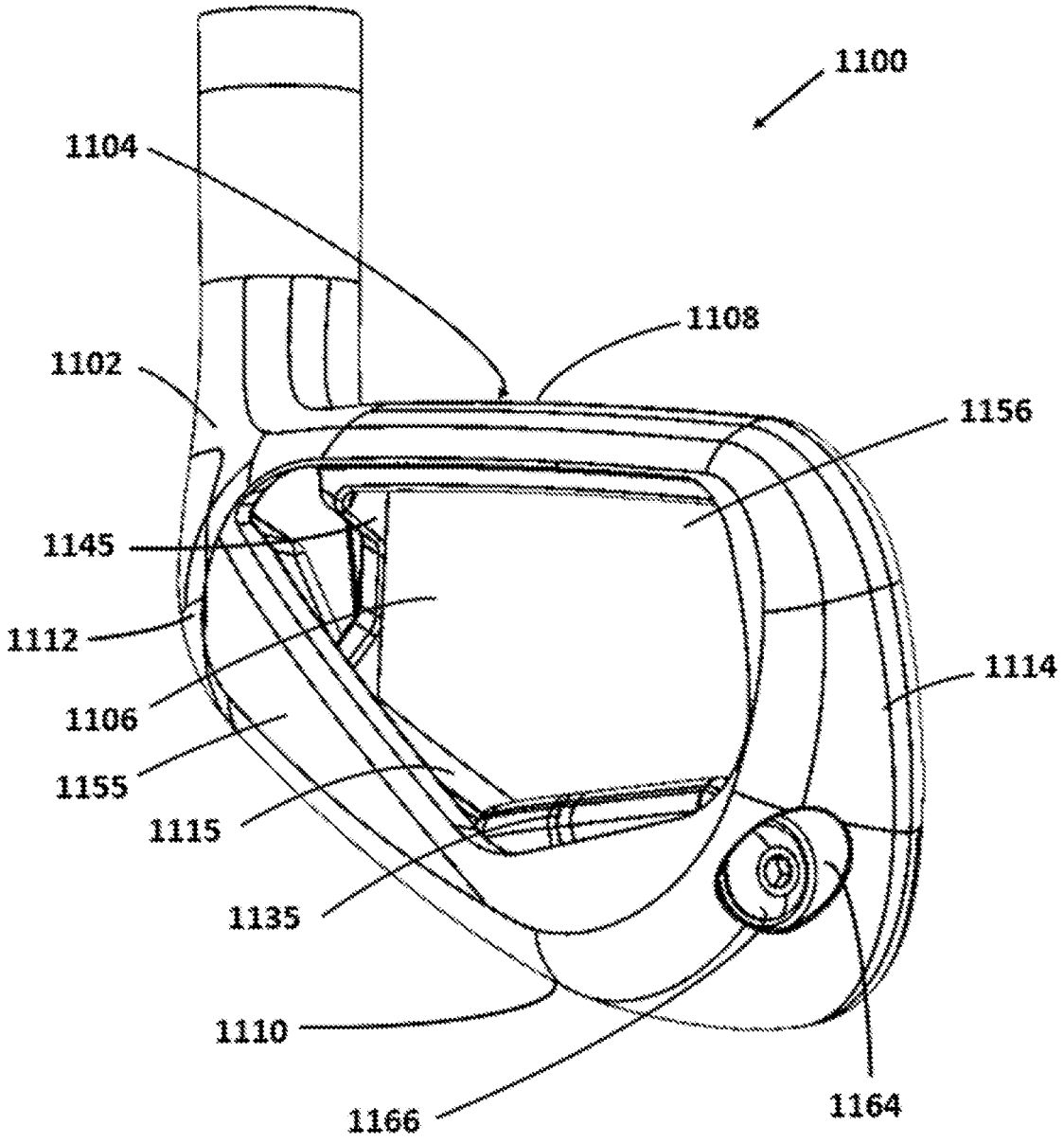
FIG. 11 is a perspective view of a golf club head on another example of a golf club head having an inner wall.
Figure 12:
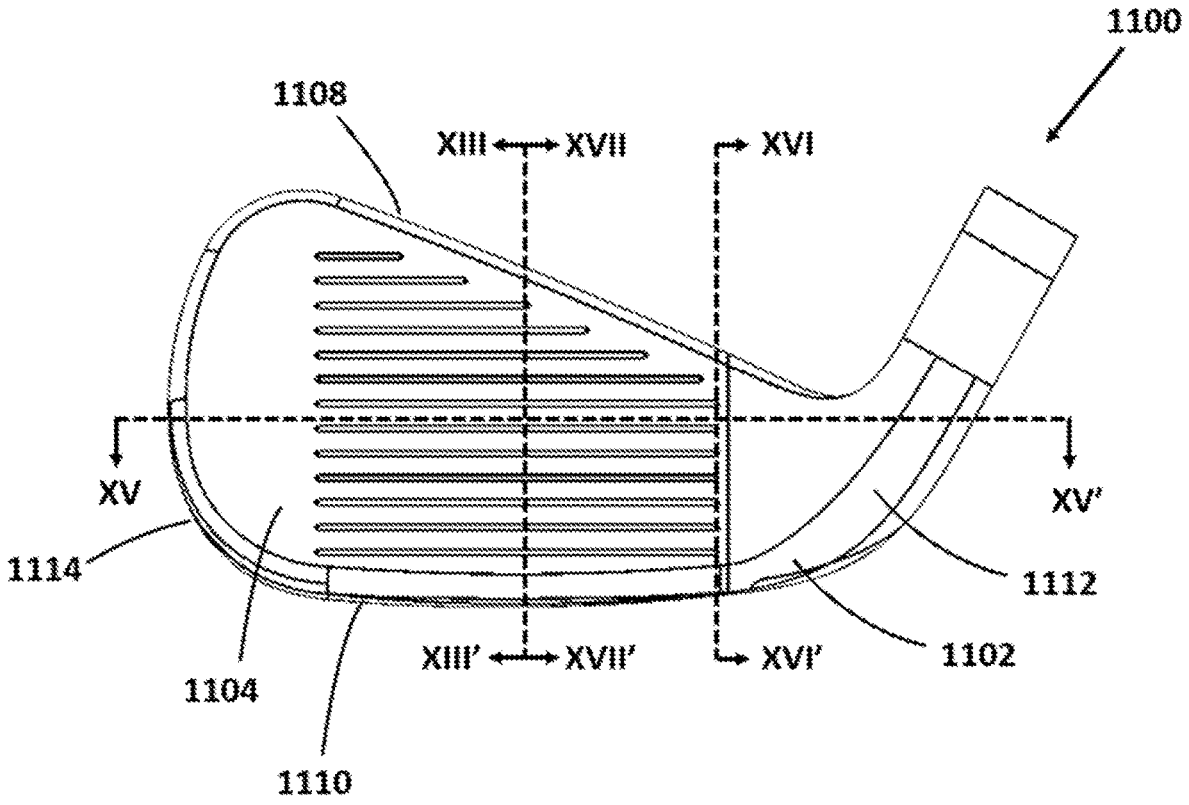
FIG. 12 is a front view of the golf club head of FIG. 11.
Figure 13:
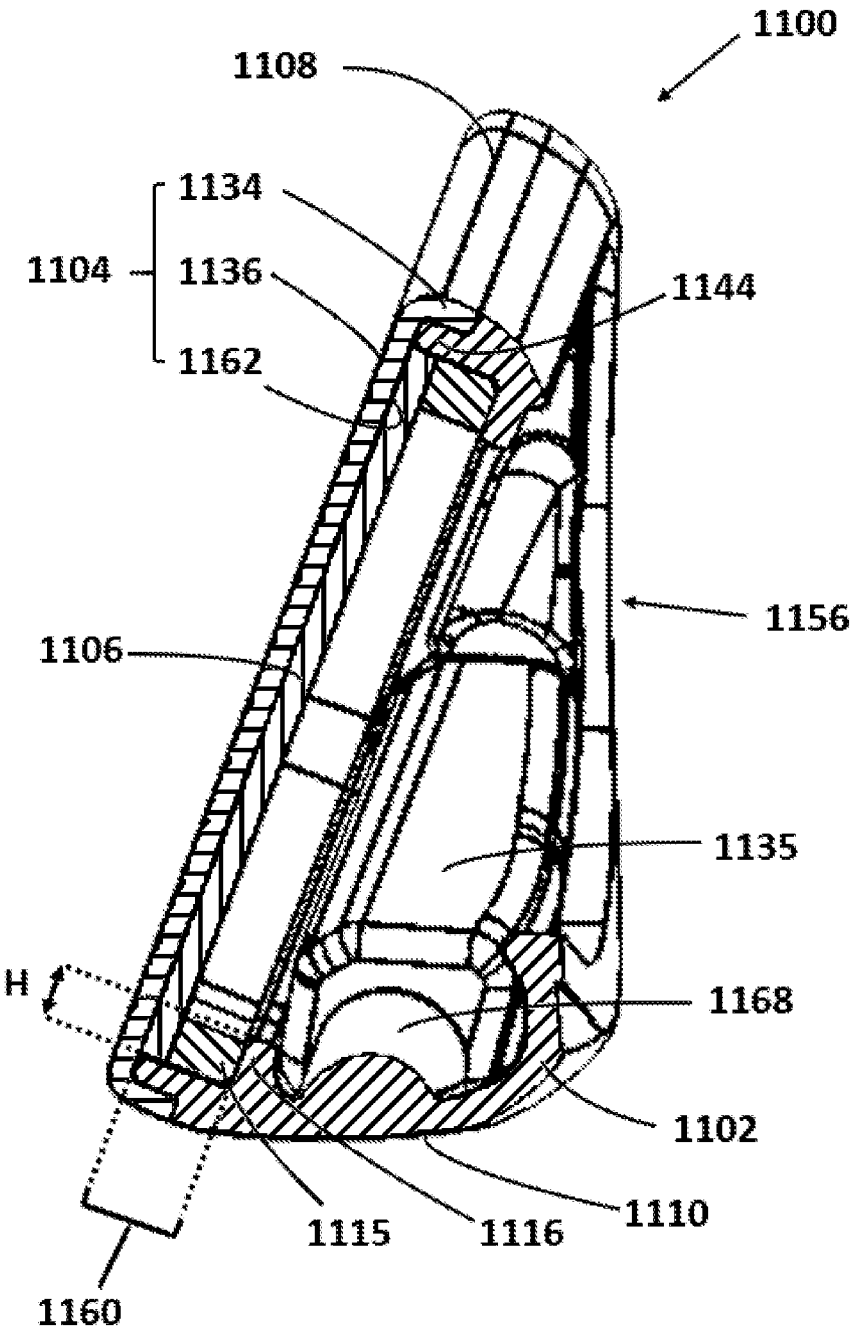
FIG. 13 is a sectional view of the golf club head of FIG. 11 taken along the line XIII-XIII' of FIG. 12.
Figure 14:
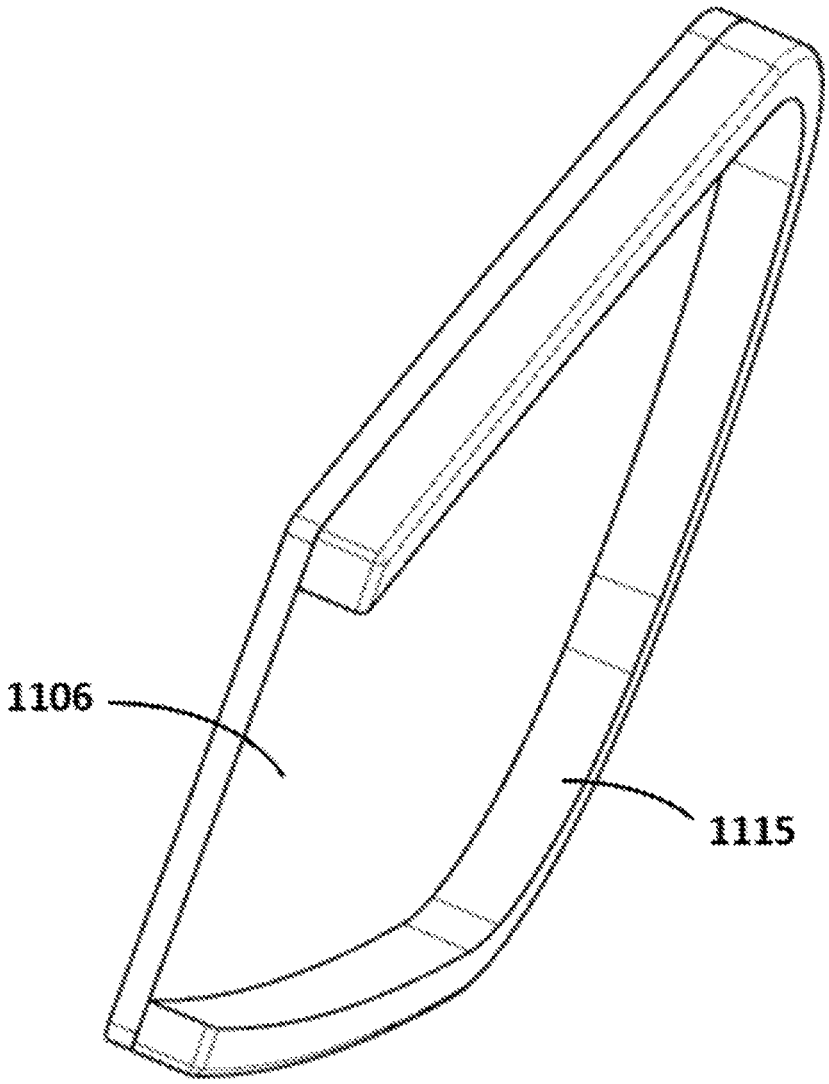
FIG. 14 is a perspective view of the inner wall and the perimeter support member of the golf club head of FIG. 11.
Figure 15:
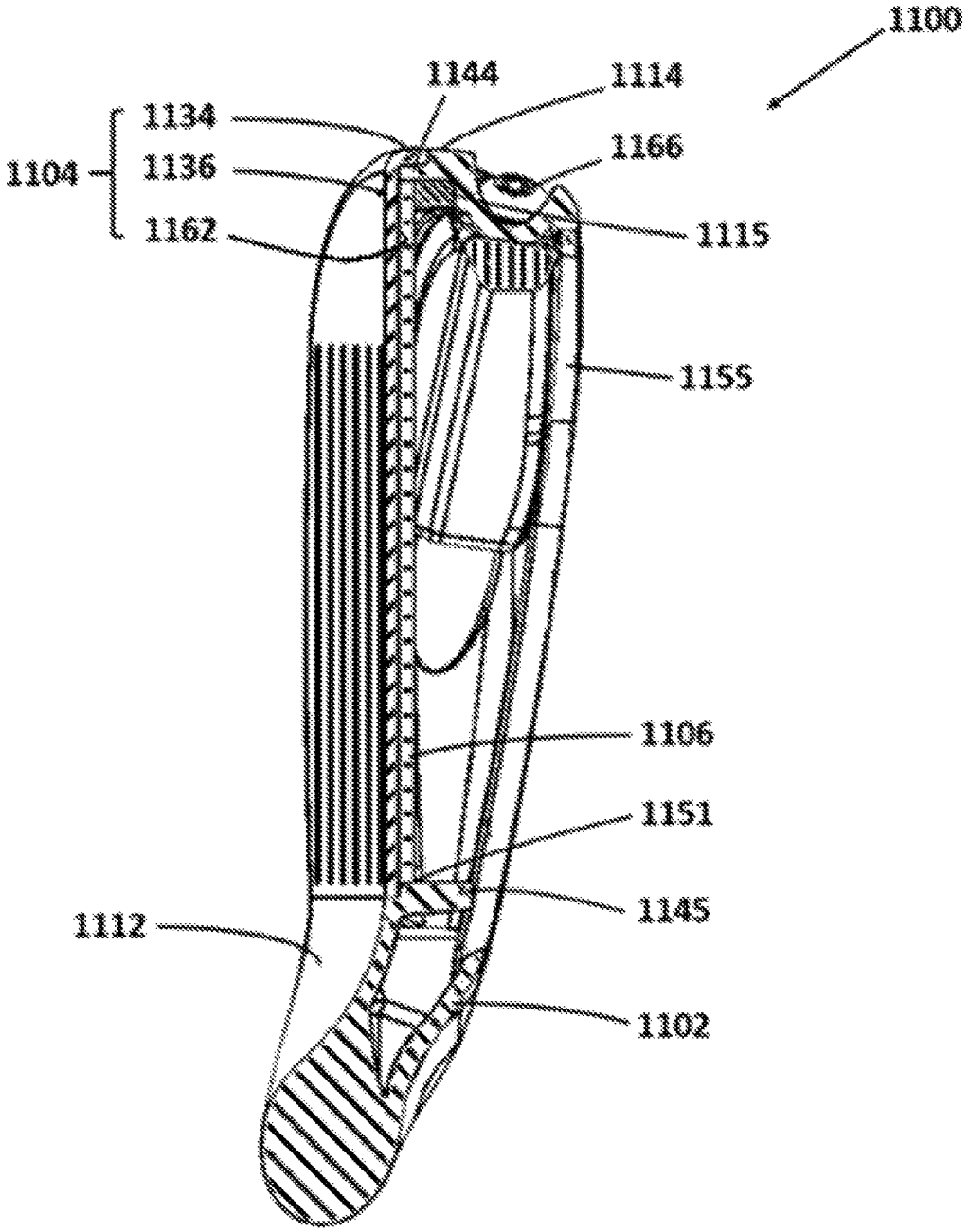
FIG. 15 is another sectional view of the golf club head of FIG. 11 taken along the line XV-XV' of FIG. 12.
Figure 16:
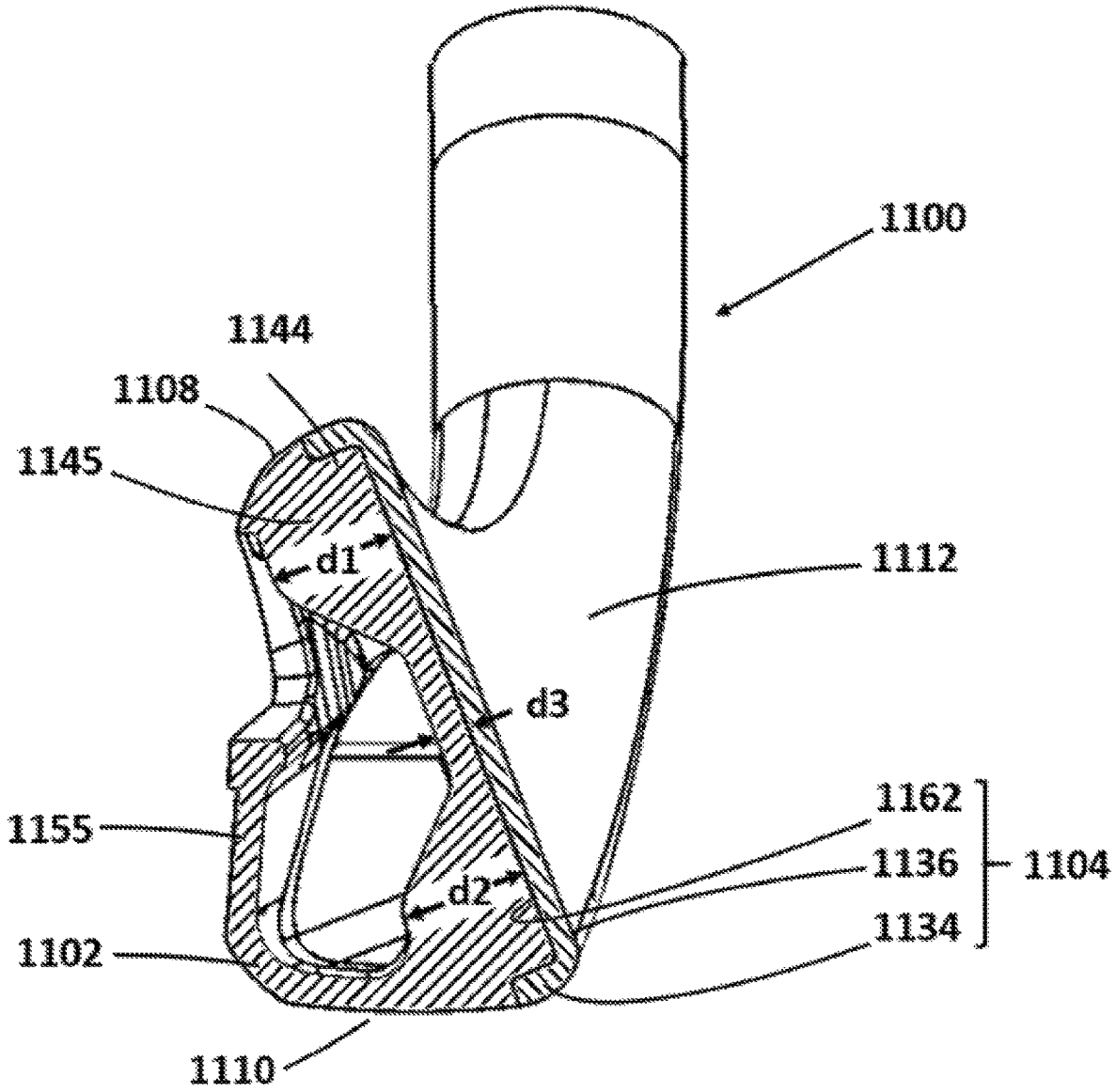
FIG. 16. is another sectional view of the golf club head of FIG. 11 taken along the line XVI-XVI' of FIG. 12.
Figure 17:
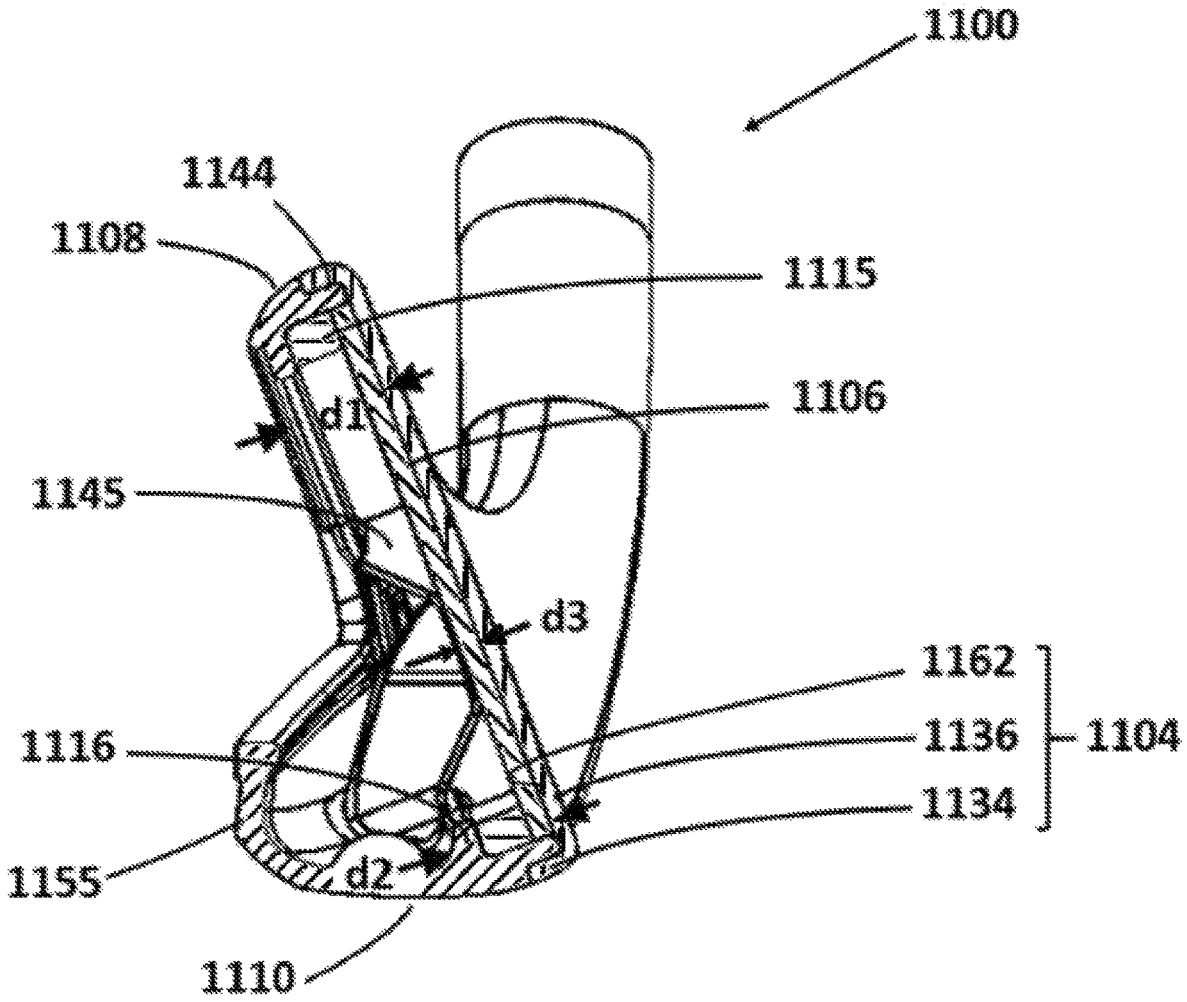
FIG. 17 is another sectional view of the golf club head of FIG. 11 taken along the line XVII-XVII' of FIG. 12.

FIGS. 11 through 17 depict a golf club head in accordance with another embodiment of the present invention. More specifically, FIGS. 11 through 17 show a golf club head 1100 including a golf club head body 1102 and a striking face 1104. The golf club head body 1102 includes a perimeter defined by a sole portion 1110, a topline portion 1108 opposite the sole portion 1110, a toe portion 1114, and a heel portion 1112 opposite the toe portion 1114. A back portion 1155 and a rear opening 1156 define a rear portion of the golf club head body 1102 opposite the striking face 1104. An inner wall 1106 and a perimeter support member 1115 are disposed within the golf club head body 1102 and behind the striking face 1104. A mass element 1135 may be attached to the golf club head body 1102, as is described in greater detail below. FIG. 11 is a perspective view of golf club head 1100, FIG. 12 is a front view of golf club head 1100, FIG. 13 is a sectional view of the golf club head 1100 taken along the line XIII-XIII' in FIG. 12, FIG. 14 is a perspective view of the inner wall 1106 and the perimeter support member 1115 of golf club head 1100, FIG. 15 is a sectional view of the golf club head 1100 taken along the line XV-XV' in FIG. 12, FIG. 16 is a sectional view of the golf club head 1100 taken along the line XVI-XVI' in FIG. 12, and FIG. 17 is a sectional view of the golf club head 1100 taken along the line XVII-XVII'.

This embodiment of the present invention allows for the striking face 1104 to be attached to the golf club head body 1102 prior to insertion of the inner wall 1106 into the golf club head 1100. The striking face 1104 and the golf club head body 1102 may be cast or forged together, or the striking face 1104 may be attached to the golf club head body 1102 via welding, brazing, adhesive, friction fit, mechanical fasteners such as screws or rivets, along with any other suitable attachment method. As the striking face

1104 may be attached to the golf club head body 1102 without the inner wall 1106 present, the inner wall 1106 may be formed of materials that may not be able to withstand the extreme heat associated with the welding process.

According to an exemplary embodiment of the present invention, the inner wall 1106 is positioned within the golf club head body 1102 by insertion through the rear opening 1156, and therefore the striking face 1104 may be attached to the golf club head body 1102 along an entire perimeter of the striking face 1104, which reduces the likelihood of the striking face 1104 separating from the golf club head body 1102 due to mechanical failure.

The types of materials used to create the inner wall 1106 and the striking face 1104, and the dimensions thereof, may differ as described above with regard to other embodiments. According to an exemplary embodiment of the present invention, the inner wall 1106 may be formed out of a carbon fiber, fiberglass, or a composite type material. The inner wall 1106 may be inserted through the rear opening 1156 in an uncured state and subsequently cured in place. In this case, the rear opening 1156 may be dimensioned so as to only receive the inner wall 1106 therethrough when the inner wall 1106 is in a flexible uncured state. As the inner wall 1106 reinforces the striking face 1104, the striking face 1104 may be thinner than it would otherwise be in absence of the inner wall 1106. The inner wall 1106 preferably has a thickness of less than 5.0 mm.

According to some embodiments, a release agent (not shown) may be interposed between the inner wall 1106 and the striking face 1104 to reduce friction therebetween, and ensure that the inner wall 1106 and the striking face 1104 are free to slide relative to each other during impact deformation during the striking of a golf ball. The release agent may include a release film, an anti-friction coating, and/or a mold release lubricant.

Referring to FIG. 13, the striking face 1104 includes a striking portion 1136 and a rim 1134. The rim 1134 extends substantially orthogonally away from the striking portion 1136 toward the rear portion of the golf club head body 1102 and defines the perimeter of the striking face 1104 along the sole portion 1110, toe portion 1114, and topline portion 1108. The rim 1134 is secured to a contact rim 1144 of the golf club head body 1102. The contact rim 1144 extends toward a rear surface 1162 of the striking face 1104 from the sole portion 1110, toe portion 1114, and topline portion 1108 of the golf club head body 1102. In the present embodiment, the contact rim 1144 contacts both the rim 1134 and the rear surface 1162 of the striking face 1104 along the perimeter of the striking face 1104. Alternatively, the contact rim 1144 may contact only the rim 1134 of the striking face 1104, such that the rear surface 1162 of the striking face 1104 is spaced apart from the contact rim 1144 as shown in FIG. 8 above.

A front surface of the inner wall 1106 contacts the rear surface 1162 of the striking face 1104 and extends toward a surface of the contact rim 1144 opposite the rim 1134 of the striking face 1104. A ledge 1116 extends from the golf club head body 1102 toward an interior of the golf club head body 1102 and is spaced apart from the striking face 1104. The ledge 1116 is formed in the sole portion 1110, toe portion 1114, and topline portion 1108 of the golf club head body 1102, but is not formed in the heel portion 1112. A perimeter portion of the inner wall 1106 and a perimeter support member 1115 are disposed so as to fill a gap 1160 between the ledge 1116 and the rear surface 1162 of the striking face 1104. As shown in FIG. 13, the perimeter portion of the inner wall 1106 and the perimeter support member 1115 completely fill the gap 1160 in a fore-aft direction extending rearward from the striking face 1104 toward the rear portion of the golf club head body 1102.

According to the present embodiment, the perimeter support member 1115 is disposed so as to contact the ledge 1116, a rear surface of the inner wall 1106, and the contact rim 1144, thereby mechanically locking the inner wall 1106 in place against the rear surface 1162 of the striking face 1104. The perimeter support member 1115 and the inner wall 1106 may both be positioned within the golf club head body 1102 by insertion through the rear opening 1156. The perimeter support member 1115 may be formed of any number of materials, but is preferably formed of a resin material or an epoxy, and may include chopped fiber.

As shown in FIG. 13, according to an exemplary embodiment of the present invention the perimeter support member 1115 extends from the contact rim 1144 less than a height H of the ledge 1116. However, it is within the scope of the present invention for the perimeter support member 1115 to extend from the contact rim 1144 a distance that is equal to or greater than the height of the ledge 1116.

FIGS. 11 and 13 also illustrate an exemplary manner in which the mass element 1135 may be attached to the golf club head body 1102. As shown in FIG. 11, a threaded fastener 1166 passes through a fastener receiving hole 1164 defined in the toe portion 1114 of the golf club head body 1102. The fastener receiving hole 1164 may be counterbored or countersunk such that the head of the threaded fastener 1166 does not extend beyond the external contour of the golf club head body 1102. As shown in FIG. 13, the threaded fastener 1166 passes through a through opening defined in the mass element 1135 and is mated with a threaded boss 1168 defined in the sole portion 1110 of the golf club head body 1102. According to an exemplary embodiment, the mass element 1135 may be attached to the golf club head body 1102 after the insertion of the inner wall 1106 which increases the effective size of the rear opening 1156 when inserting the inner wall 1106.

Referring to FIG. 14, a heel side perspective view of the inner wall 1106 and the perimeter support member 1115 is provided to better illustrate the structure of these elements. As shown in FIG. 14, according to the current exemplary embodiment of the present invention, the perimeter support member 1115 is not disposed along the entire perimeter of the inner wall 1106, as the perimeter support member 1115 is not disposed along the portion of the inner wall 1106 that corresponds to the heel portion 1112 of the golf club head body 1102. The mass saved by omitting the perimeter support member 1115 and the ledge 1116 in the heel portion 1112 of the golf club head body 1102 may be utilized as discretionary mass and located in more beneficial portions of the golf club head body 1102, such as in the mass element 1135. It is also within the scope of the present invention for the perimeter support member 1115 to be disposed along the entire perimeter portion of the inner wall 1106.

FIG. 15 is a sectional view of the golf club head 1100 of FIG. 11 taken along the line XV-XV' in FIG. 12. As shown in FIG. 15, the interface between the striking face 1104 and the golf club head body 1102 is different in the heel portion 1112 than in the toe portion 1114, sole portion 1110, or topline portion 1108. According to an embodiment of the present invention, the portion of the striking face 1104 adjacent the heel portion 1112 does not include a rim 1134 and the portion of the golf club head body 1102 adjacent the heel portion 1112 does not include a contact rim 1144. The golf club head body 1102 includes a heel wall 1145 that supports and provides an attachment surface for the heel-most portion of the striking face 1104. As shown in FIG. 15, the heel wall 1145 extends from the front of the golf club head body 1102 adjacent the striking face 1104 in a rearward direction toward the back portion 1155, and extends from the sole portion 1110 to the topline portion 1108 in a vertical direction as shown in FIG. 16. A relief 1151 is defined in the heel wall 1145 and is configured to receive and support the heelmost portion of the striking face 1104. The heel wall 1145 is described in greater detail below.

FIG. 16 is a sectional view of the golf club head 1100 of FIG. 11 taken along the line XVI-XVI' in FIG. 12. The line XVI-XVI' is located at the heelmost extent of the scorelines defined on the striking face 1104. According to an embodiment of the present invention, the heel wall 1145 may extend rearward from the striking face 1104 a variable depth. As shown in FIG. 16, an upper portion of the heel wall 1145 may have a first depth d1 and a lower portion of the heel wall 1145 may have a second depth d2. A central portion of the heel wall between the upper portion and the lower portion may have a third depth d3. The depth of the heel wall 1145 may be tapered between the first depth d1 and the third depth d3, and the depth of the heel wall 1145 may be tapered between the second depth d2 and the third depth d3. According to an exemplary embodiment of the present invention, the first depth d1 and the second depth d2 may be substantially equal, while the third depth d3 is preferably less than the first depth d1 and the second depth d2. According to an alternative embodiment, the first depth d1 may be less than the second depth d2 and greater than the third depth d3 to increase mass in a lower portion of the golf club head 1100.

FIG. 17 is a sectional view of the golf club head 1100 of FIG. 11 taken along the line XVII-XVII' in FIG. 12. The inner wall 1106 and the perimeter support member 1115 abut the heel wall 1145. The perimeter support member 1115 is not disposed along the entirety of the heel wall 1145, but rather the perimeter support member 1115 only contacts the heel wall 1145 proximate the contact rim 1144 in the topline portion 1108 and the sole portion 1110 of the golf club head body 1102.

As shown in FIG. 17, the upper portion and the lower portion of the heel wall 1145 extend rearward from the striking face 1104 to the ledge 1116. Therefore, it is preferable for the first depth d1 and the second depth d2 to be substantially equal to the combined thickness of the inner wall 1106, the perimeter support member 1115, and the ledge 1116. It is preferable for the third depth d3 in the central portion of the heel wall 1145, which does not contact the perimeter support member 1115, to be substantially equal to a thickness of the inner wall 1106. When the heel wall 1145 extends a variable distance from the striking face 1104 as shown in FIGS. 16 and 17, the heel wall 1145 may still retain the inner wall 1106 and the perimeter support member 1115, while also increasing discretionary mass that may be utilized elsewhere in the golf club head 1100.

The perimeter support member 1115 and the inner wall 1106 completely fill the gap 1160 between the ledge 1116 and the rear surface 1162 of the striking face 1104. This construction not only mechanically locks the inner wall 1106 in place, but also reduces unwanted vibrations and improves the acoustic signature of the golf club head 1100 as compared to a case where the gap 1160 is not completely filled. Further, the striking face 1104 may be thinner than otherwise possible if the inner wall 1106 was not provided, which increases the potential ball speed when striking a golf ball.

According to an embodiment of the present invention, the golf club head 1100 may be manufactured using a process where the inner wall 1106 and the perimeter support member 1115 are molded in place within the golf club head body 1102. Molding the inner wall 1106 and the perimeter support member 1115 within the golf club head body 1102 affords additional benefits as detailed below.

Figure 18:
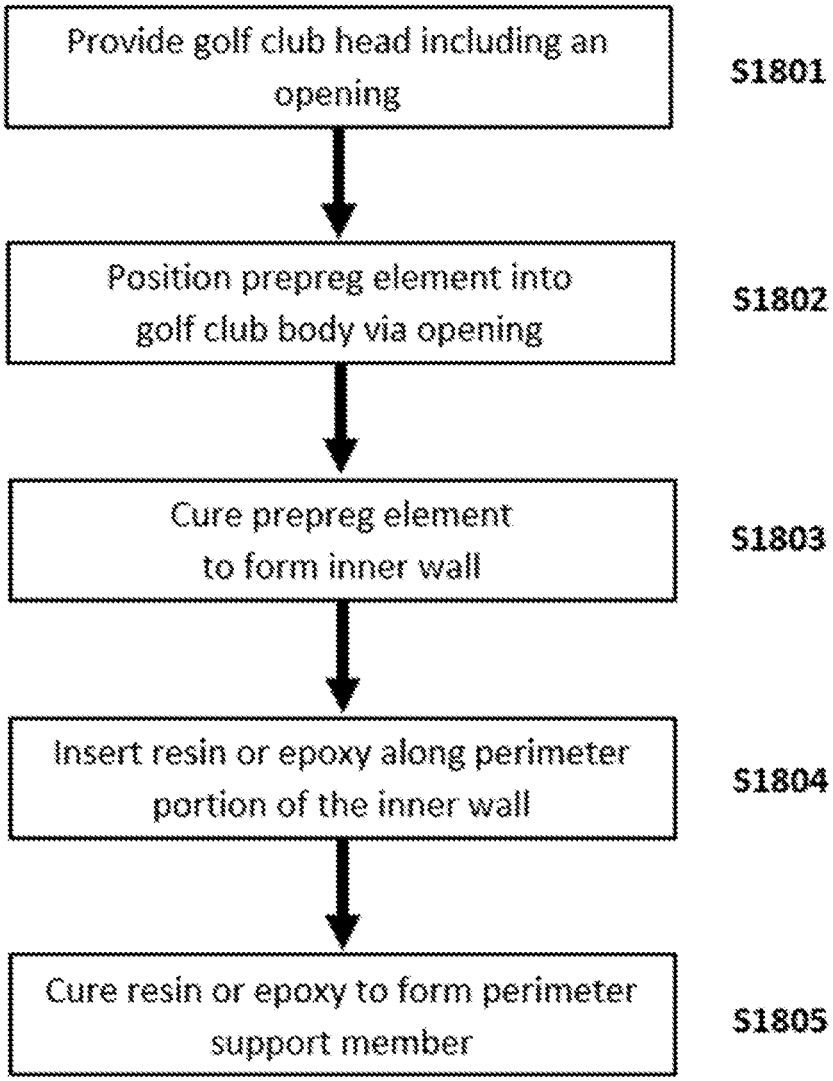
FIG. 18 is a flow chart of a method of manufacturing a golf club head of FIG. 11.

FIG. 18 is a flowchart for a method of manufacturing golf club head 1100 where the inner wall 1106 and the perimeter support member 1115 are molded within the golf club head body 1102. According to an exemplary embodiment of the present invention, in a step S1801 the golf club head body 1102 and the striking face 1104 may be provided attached together. Then in a step S1802, a prepreg element may be positioned in the golf club head body 1102 against a rear surface 1162 of the striking face 1104 via the rear opening 1156. Optionally, a release agent (e.g., a release film, an anti-friction coating, or a mold release lubricant) may be inserted with or prior to the insertion of the prepreg element so as be interposed between the rear surface 1162 of the striking face 1104 and the prepreg element. The prepreg element may include composite fibers impregnated with a thermoset polymer matrix material such as an epoxy or a thermoplastic resin. In step S1803, the prepreg element is cured at a predetermined time, temperature, and pressure so as to form the inner wall 1106. In step S1804, a resin or epoxy is inserted between a perimeter portion of the inner wall 1106 and the ledge 1116 so as to completely fill the gap 1160 in a fore-aft direction extending rearward from the striking face 1104 toward the rear portion of the golf club head body 1102 and mechanically lock the inner wall 1106 in place. The resin or epoxy may include chopped fibers. Preferably, the resin or epoxy is only inserted along the sole portion 1110, toe portion 1114, and topline portion 1108 of the inner wall 1106, as the ledge 1116 is not formed in the heel portion 1112. In step S1805, the resin or epoxy is cured at a predetermined time, temperature, and pressure so as to form the perimeter support member 1115.

When the inner wall 1106 and the perimeter support member 1115 are molded within the golf club head body 1102, the inner wall 1106 and the perimeter support member 1115 may better conform to the striking face 1104, the heel wall 1145, the ledge 1116, and the contact rim 1144. As a result, the acoustic properties of the golf club head 1100 are improved because undesirable vibrations between the golf club head body 1102, the inner wall 1106, and the perimeter support member 1115 may be reduced. Acoustic properties critical attributes in golf club design, as golf clubs that do not sound appealing do not instill confidence.

Additionally, because the prepreg element may be flexible and may flow during the curing process, the rear opening 1156 may be sized independently of the size of the inner wall 1106 according to this exemplary embodiment of the present invention.

According to an alternative embodiment of the present invention, steps S1803 and S1805 may be performed after the steps S1802 and S1804, such that the prepreg element and the perimeter support member 1115 are cured simultaneously. The prepreg element and the perimeter support member 1115 may be bonded together in a case where they have compatible resin matrices and are cured simultaneously.

According to another alternative embodiment, in the step S1802, the prepreg element may be positioned so as to completely fill the gap 1160 between the rear surface 1162 of the striking face 1104 and the ledge 1116. In such a case the steps S1804 and S1805 are omitted because the cured prepreg element effectively forms both the inner wall 1106 and the perimeter support member 1115.

Figure 19:
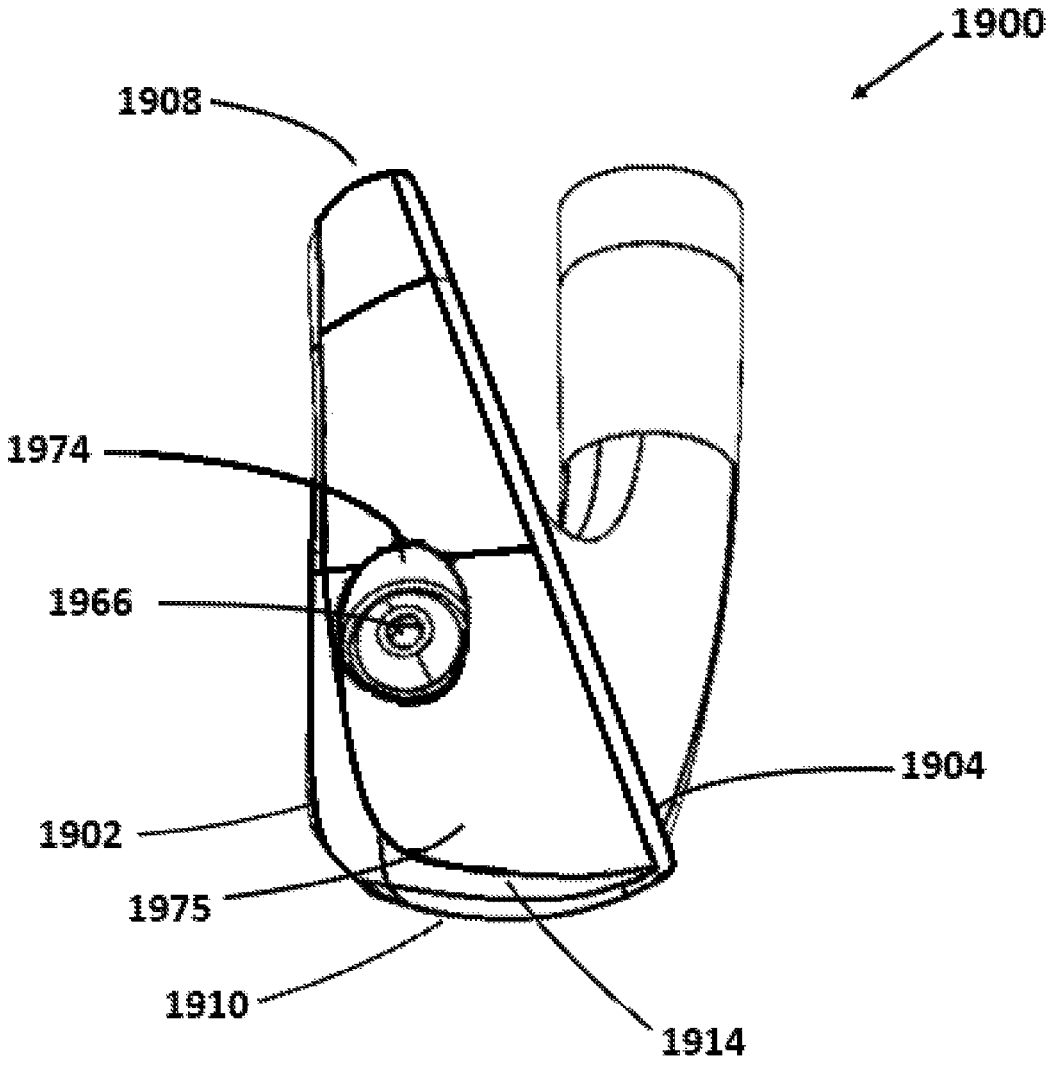
FIG. 19 is a toe side view of another example of a golf club head having an inner wall.
Figure 20:
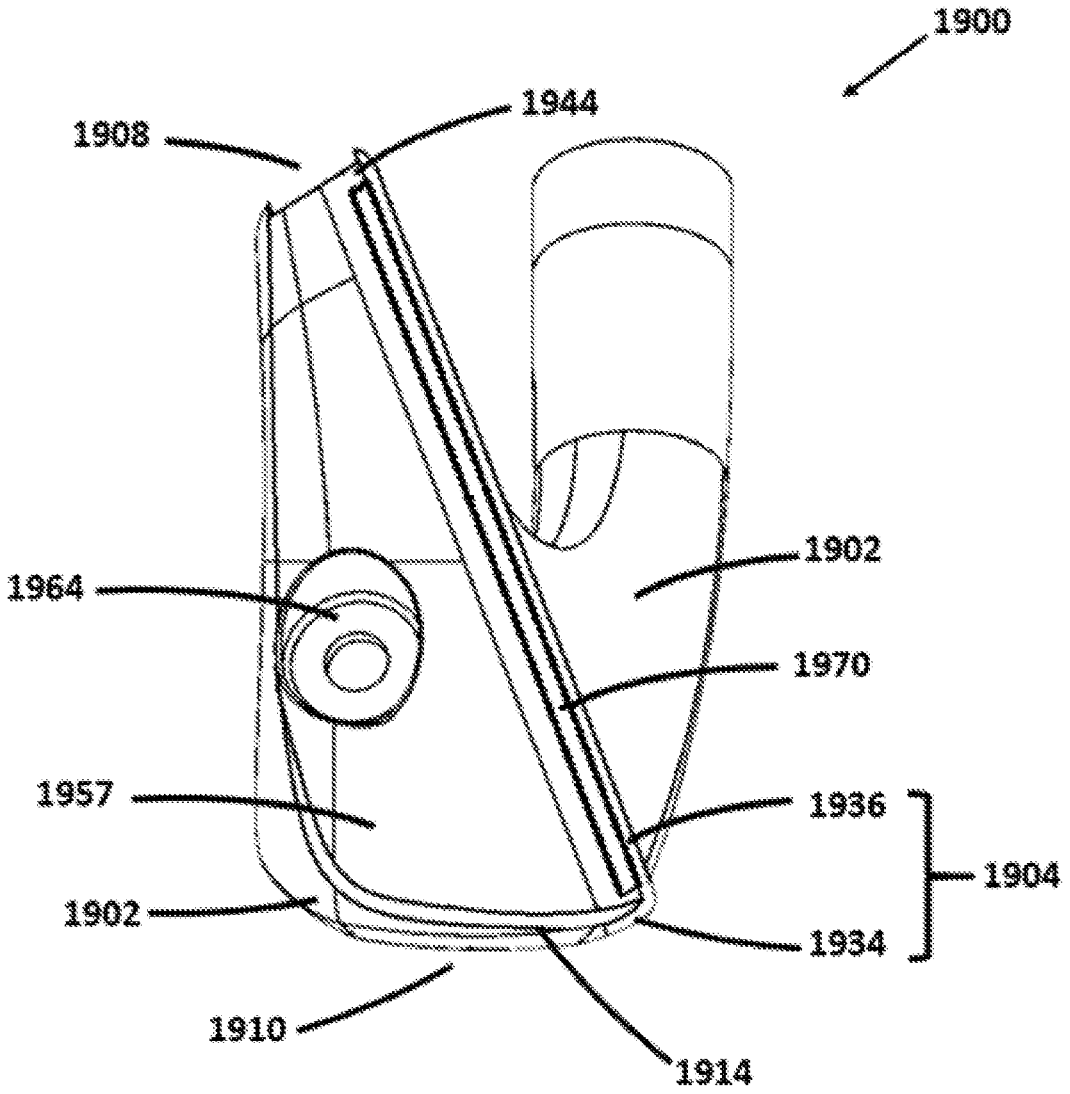
FIG. 20 is a toe side view of the golf club head of FIG. 19 with the toe cap obscured.
Figure 21:
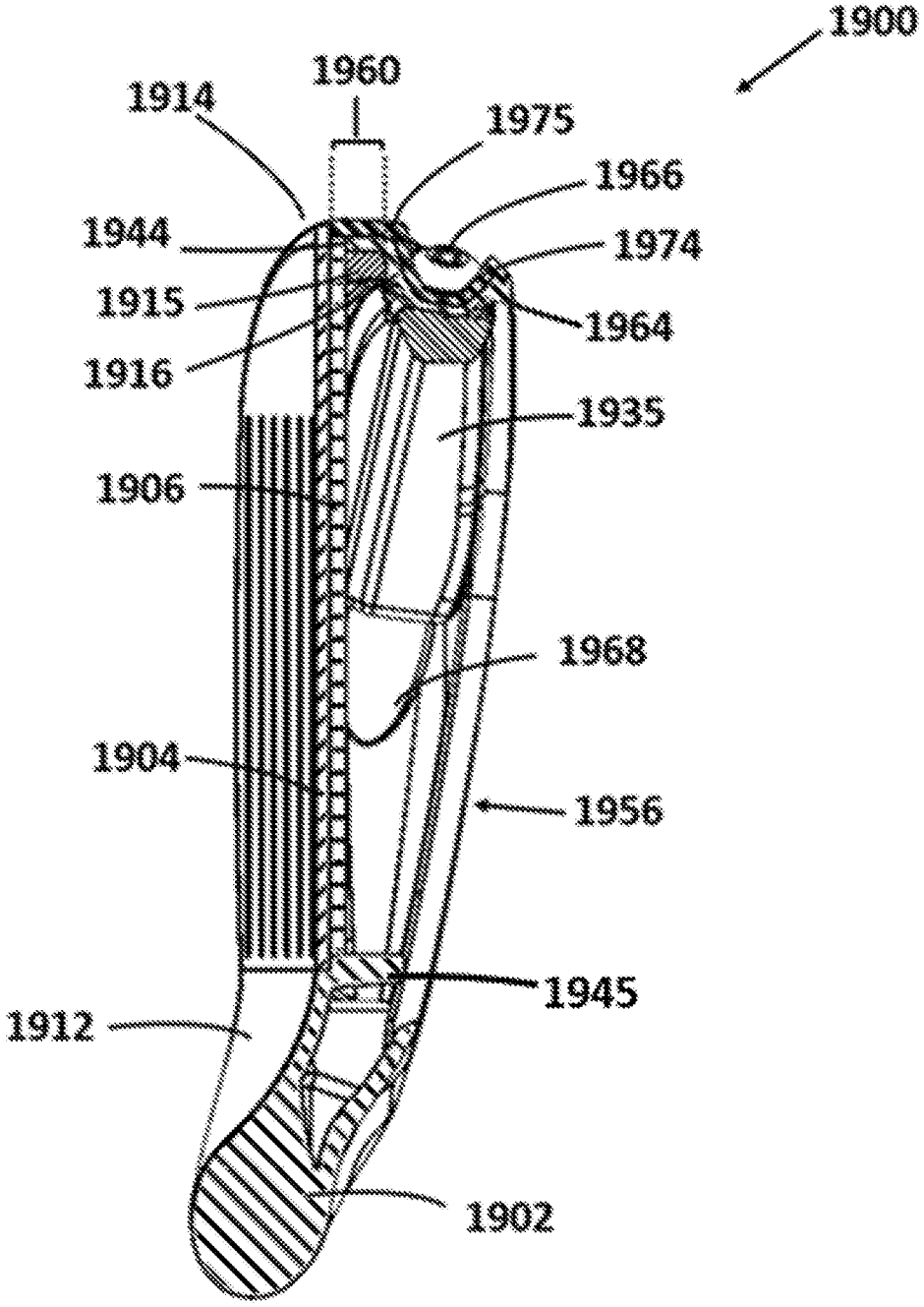
FIG. 21 is a sectional view of the golf club head of FIG. 19 taken along a line corresponding to the line XV-XV' of FIG. 12.

FIGS. 19 through 21 depict a golf club head 1900 according to yet another embodiment of the present invention. FIG. 19 is a side view of golf club head 1900, FIG. 20 is a side view of golf club head 1900 with toe cap 1975 omitted, and FIG. 21 is a sectional view of golf club head 1900 taken along a line equivalent to line XV-XV' in FIG. 12. Golf club head 1900 differs from golf club head 1100 in several ways, but discussion of structurally similar components may be omitted.

As shown in FIG. 19, the golf club head 1900 includes a toe cap 1975. As described below, the toe cap 1975 is adapted to capture and retain an inner wall 1906 by enclosing an opening 1970 defined in the toe portion 1914 of the golf club head body 1902. The toe cap 1975 may be secured to the golf club head body 1902 by a threaded fastener 1966 that passes through a first fastener receiving hole 1974 defined in the toe cap 1975. The first fastener receiving hole 1974 may be countersunk or counterbored so that the head of the threaded fastener 1966 does not extend beyond an external contour of the golf club head 1900. The toe cap 1975 may conform with the overall shape of the golf club head 1900 and may be formed of any number of materials and alloys including tungsten, steel, titanium, and urethane.

FIG. 20 is a side view of golf club head 1900 with the toe cap 1975 omitted. By omitting the toe cap 1975 several unique features of golf club head 1900 are more clearly shown. First of all, golf club head 1900 includes a toe opening 1970 defined in the toe portion 1914 of the golf club head body 1902 proximate the striking face 1904. A width of the toe opening 1970 may be slightly greater than a thickness of the inner wall 1906 so as to accommodate insertion of the inner wall 1906 therethrough.

The striking face 1904 may be attached to the golf club head body 1902 via welding, brazing, an adhesive, friction fit, mechanical fasteners such as screws or rivets, or through a casting or forging process.

The striking face 1904 may include a striking portion 1936 and a rim 1934. According to this exemplary embodiment, the rim 1934 of the striking face 1904 is only provided along the topline portion 1908 and the sole portion 1910 of the golf club head body 1902, while the contact rim 1944 of the golf club head body 1902 is provided along the topline portion 1908, the toe portion 1914, and the sole portion 1910 of the golf club head 1900. The contact rim 1944 differs from contact rim 1144 as discussed below with reference to FIG. 21.

The striking face 1904 may be attached to the golf club head body 1902 along the sole portion 1910, the heel portion 1912, and the topline portion 1908. The striking face 1904 is not attached to the golf club head body 1902 along the toe portion 1914 because of the presence of the toe opening 1970.

A recess 1957 is defined in toe portion 1914 of the golf club head body 1902. The recess 1957 has a depth sufficient to receive the toe cap 1975 such that the external contours of the toe cap 1975 blend with the external contours of the golf club head 1900.

A second fastener receiving hole 1964 is defined within the recess 1957 in the toe portion 1914 of the golf club head body 1902. The second fastener receiving hole 1964 is configured to receive the first fastener receiving hole 1974 therein, which, along with the recess 1957 inhibits the toe cap 1975 from moving relative to the golf club head body 1902.

FIG. 21 is a sectional view taken along a line equivalent to line XV-XV' in FIG. 12. FIG. 21 illustrates how the toe cap 1975 matches the external contours of the toe portion 1914 of the golf club head 1900. FIG. 21 also illustrates the manner in which the threaded fastener 1966 mates with the golf club head body 1902.

The threaded fastener 1966 may be configured to pass through the first fastener receiving hole 1974, the second fastener receiving hole 1964, and the mass element 1935 before mating with the threaded boss 1968 defined in the sole portion 1910 of the golf club head body 1902 to secure the toe cap 1975 and the mass element 1935 in place. The threaded boss 1968 and the mass element 1935 may be substantially similar to those described above with regard to the golf club head 1100. Alternatively, the threaded fastener 1966 may be mated with threads defined in the second fastener receiving hole 1964 in a case where a mass member is excluded or secured through other means.

FIG. 21 also illustrates how the contact rim 1944 has a slightly different construction in the toe portion 1914 when compared to contact rim 1144. The contact rim 1944 extends to the rear surface of the inner wall 1906 rather than the rear surface of the striking face 1904 to accommodate the presence of the toe opening 1970. Therefore, the contact rim 1944 supports the striking face 1904 through the inner wall 1906 along the toe portion 1914 of the golf club head body 1902.

A ledge 1916 extends from the golf club head body 1902 toward an interior of the golf club head body 1902 and is spaced apart from the rear surface of the striking face 1904 so as to define a gap 1960 therebetween. The ledge 1916 is formed in the sole portion 1910, toe portion 1914, and topline portion 1908 of the golf club head body 1902, but the ledge 1916 is not formed in the heel portion 1912 of the golf club head body 1902 as illustrated above in FIGS. 13 and 17 relating to golf club head 1100.

As described above, by attaching the striking face 1904 to the golf club head body 1902 prior to inserting the inner wall 1906, the inner wall 1906 and the perimeter support member 1915 may be composed of materials that would not be able to withstand the extreme heat associated with, for example, a welding process.

According to an exemplary embodiment of the present invention, the inner wall 1906 may be formed out of a carbon fiber, fiberglass, an aluminum alloy, or a composite type material. The perimeter support member 1915 may be formed of any number of materials, but is preferably formed of a resin material or an epoxy, and may include chopped fiber.

The perimeter support member 1915 is substantially similar to the perimeter support member 1115 of golf club head 1100. The perimeter support member 1915 is positioned within the golf club head body 1902 through the rear opening 1956.

The perimeter support member 1915 is disposed between the inner wall 1906 and the ledge 1916 along the sole portion 1910, the toe portion 1914, and the topline portion 1908 of the golf club head body 1902, but not along the entirety of the heel wall 1945 as illustrated above in FIGS. 13 and 17 relating to golf club head 1100. The perimeter support member 1915 and a perimeter portion of the inner wall 1906 completely fill the gap 1960 between the rear surface of the striking face 1904 and the ledge 1916 in a fore-aft direction extending rearward from the striking face 1904 toward the rear portion of the golf club head body 1902 to mechanically lock the inner wall 1906 in place.

According to some embodiments, a release agent (not shown) may be interposed between the inner wall 1906 and the striking face 1904 to reduce friction therebetween, and ensure that the inner wall 1906 and the striking face 1904 are free to slide relative to each other during impact deformation during the striking of a golf ball. The release agent may include a release film, an anti-friction coating, or a mold release lubricant.

According to an alternative embodiment of the present invention, the toe cap 1975 may include a rib (not shown) projecting into the toe opening 1970 such that the forward-most portion of the contact rim 1944 in the toe portion 1914 of the golf club head body 1902 contacts the toe cap 1975 rather than the rear surface of the inner wall 1906. In this case, the inner wall 1906 is shortened in a heel-toe dimension to accommodate the rib of the toe cap 1975.

The combination of the inner wall 1906 and the perimeter support member 1915 mechanically lock the inner wall 1906 in place against the rear surface of the striking face 1904. As described above, this construction reduces undesirable vibrations during impact with a golf ball, and thereby improves the acoustics of the golf club head. Further, the striking face 1904 may be thinner than otherwise possible if the inner wall 1906 was not provided, which increases potential ball speed when striking a golf ball.

Figure 22:
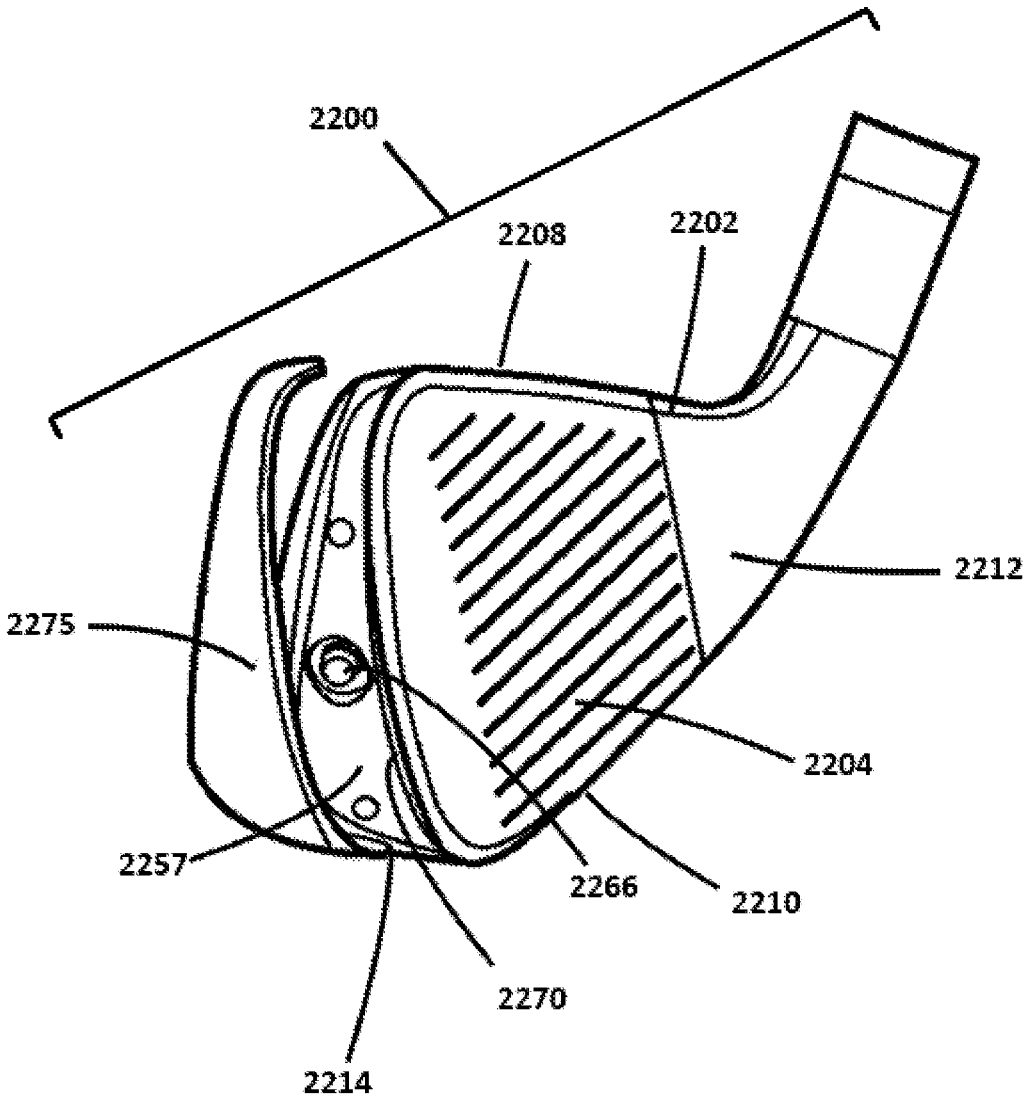
FIG. 22 is an exploded perspective view of another example of a golf club head having an inner wall.
Figure 23:
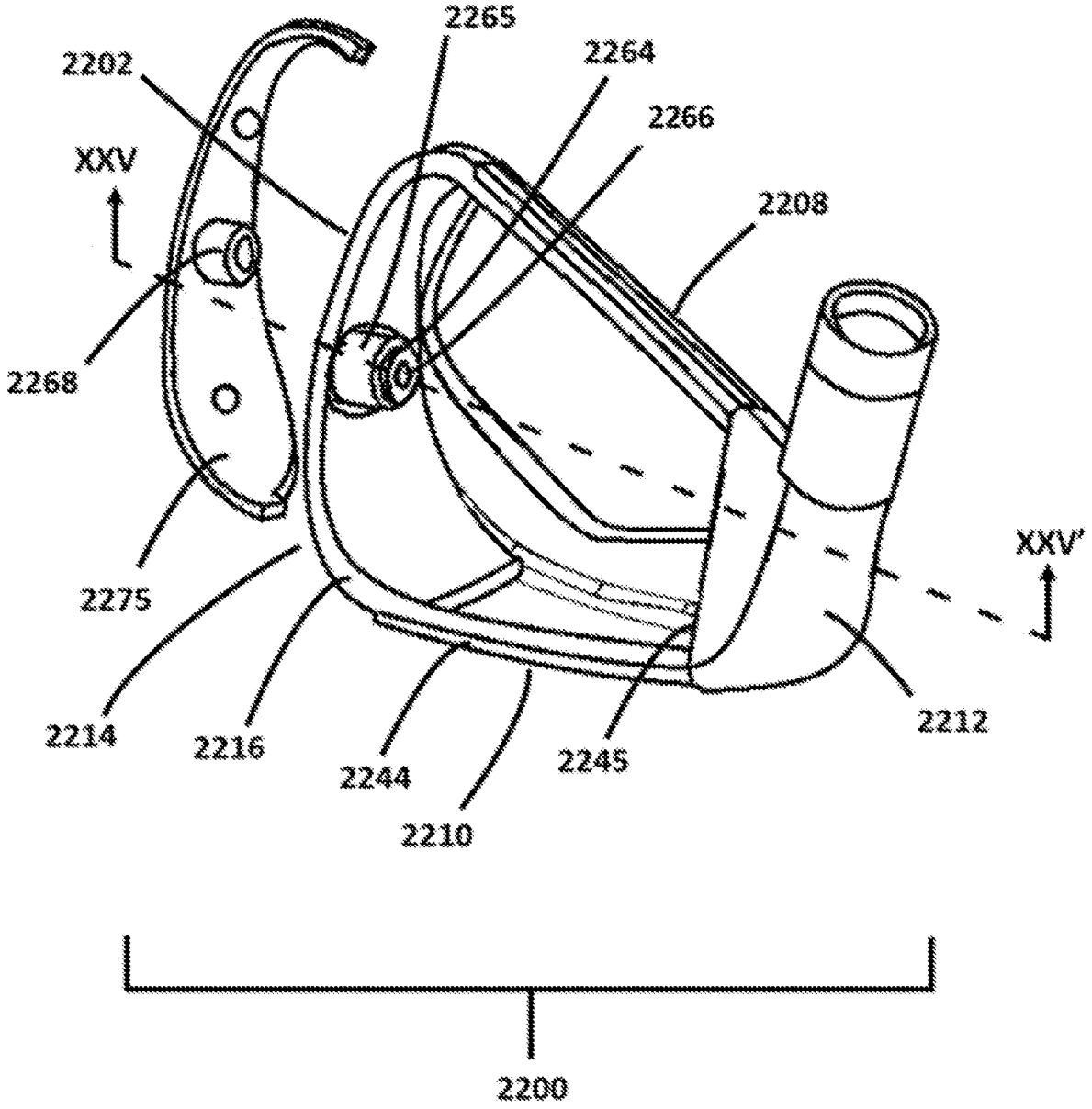
FIG. 23 is an exploded perspective view of the golf club head of FIG. 22.
Figure 24:
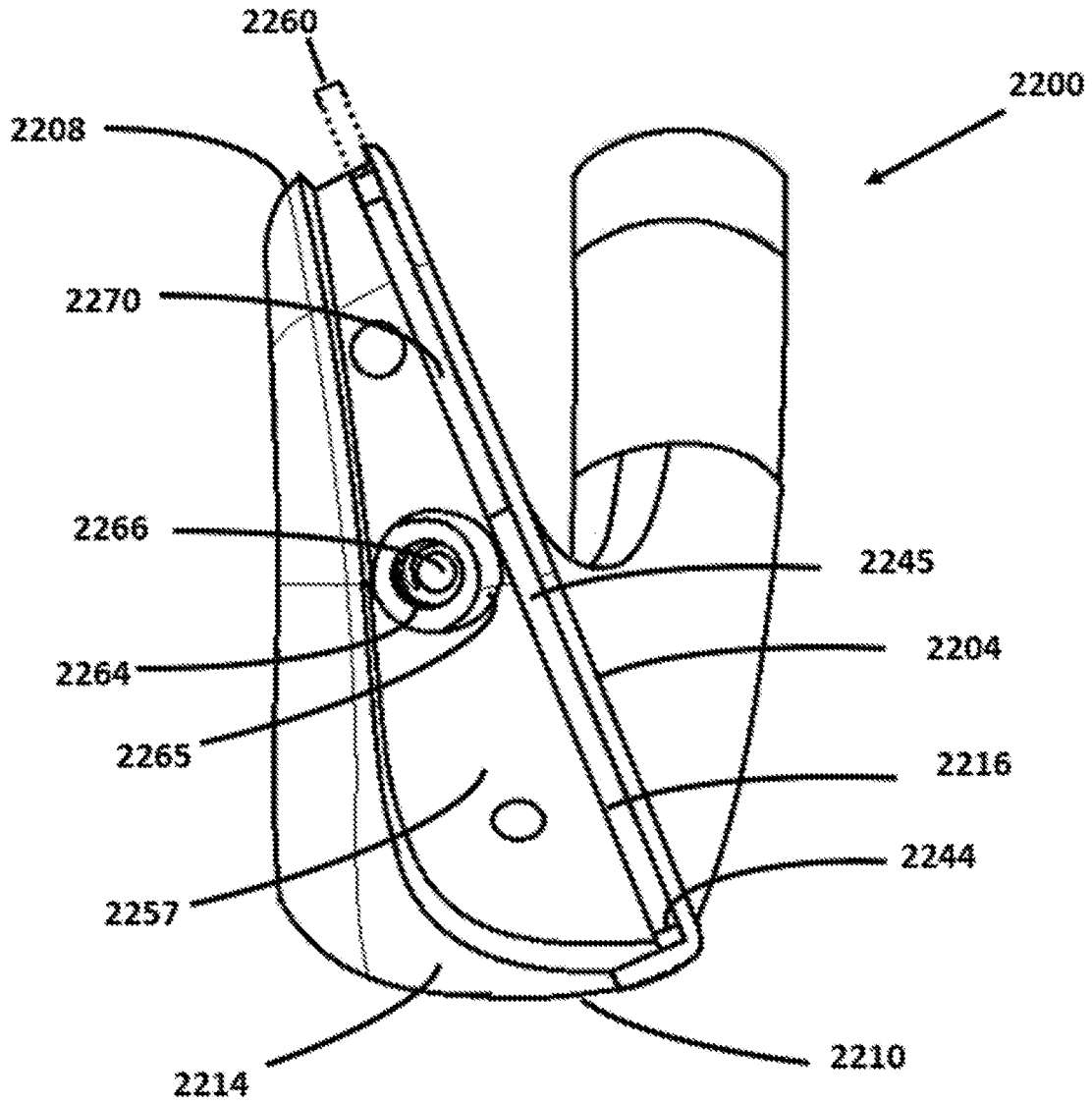
FIG. 24 is a toe side view of the golf club head of FIG. 22.
Figure 25:
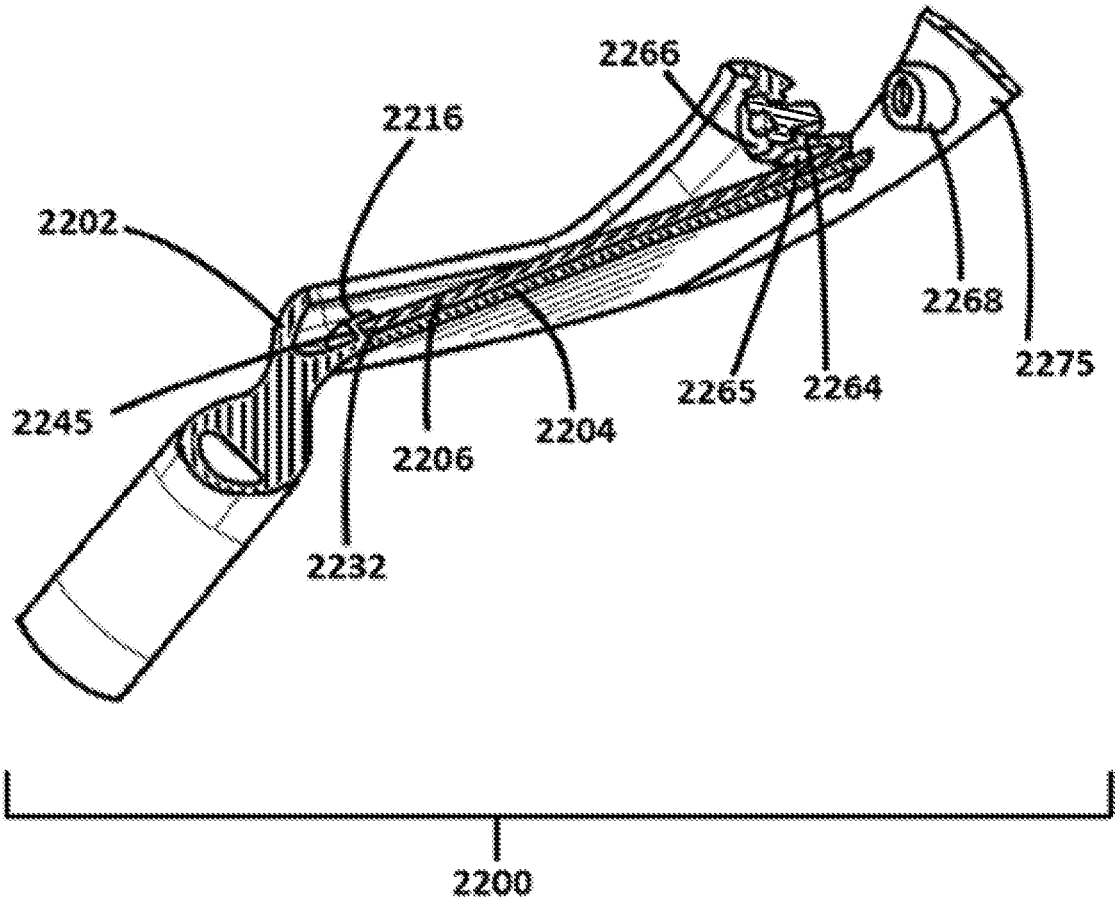
FIG. 25 is a sectional view of the golf club head of FIG. 22 taken along the line XXV-XXV' of FIG. 23.

A golf club head 2200 in accordance with yet another embodiment of the present invention is depicted in FIGS. 22 through 25. FIG. 22 shows a toe side exploded perspective view of golf club head 2200 where the toe cap 2275 is separated from the golf club head body 2202 and striking face 2204. FIG. 23 shows a heel side exploded perspective view of golf club head 2200 where the striking face 2204 and the inner wall 2206 are omitted and the toe cap 2275 is separated from the golf club head body 2202. FIG. 24 shows a toe side view of golf club head 2200 with the toe cap 2275 omitted. FIG. 25 shows a sectional view taken along the line XXV-XXV' in FIG. 23.

As shown in FIGS. 22-25, golf club head 2200 is similar to golf club head 1900 in that an inner wall 2206 is inserted through a toe opening 2270 defined in the toe portion 2214 of the golf club head body 2202, and the toe cap 2275 is adapted to capture and retain the inner wall 2206 by enclosing the toe opening 2270; however, according to the present embodiment the toe cap 2275 is attached to the golf club head body 2202 in a different manner than that described above with regard to golf club head 1900. Additionally, a rear surface of the inner wall 2206 is supported directly by a ledge 2216 defined in the golf club head body 2202, rather than a separate perimeter support member, such as perimeter support member 1915 as described above with regard to golf club head 1900.

The striking face 2204 may be attached to golf club head body 2202 prior to insertion of the inner wall 2206. The striking face 2204 and the golf club head body 2202 may be cast or forged together, or the striking face 2204 may be attached to the golf club head body 2202 via welding, brazing, adhesive, friction fit, mechanical fasteners such as screws or rivets, along with any other suitable attachment method.

As described above, attaching the striking face 2204 to the golf club head body 2202 prior to inserting the inner wall 2206, the inner wall 2206 may be composed of materials that would not be able to withstand the extreme heat associated with the welding process. According to an exemplary embodiment of the present invention, the inner wall 2206 may be formed out of a carbon fiber, fiberglass, an aluminum alloy, or a composite type material.

The striking face 2204 may be attached to the golf club head body 2202 along the sole portion 2210, topline portion 2208, and heel portion 2212 of the striking face 2204. The striking face 2204 is not attached to the golf club head body 2202 along the toe portion 2214 of the striking face 2204 to accommodate the presence of the toe opening 2270.

FIG. 23 is an exploded frontal perspective view of a golf club head 2200 with the striking face 2204 and inner wall 2206 omitted. As shown in FIG. 23, a portion of a front surface of the golf club head body 2202 is substantially parallel to the striking face 2204 and defines a ledge 2216 that supports a rear surface of the inner wall 2206 opposite the striking face 2204. As shown in FIG. 23, the ledge 2216 is disposed so as to contact an entire perimeter portion of the rear surface of the inner wall 2206, though in alternative embodiments the ledge 2216 may contact only a portion of the perimeter of the rear surface of the inner wall 2206 as illustrated above in FIG. 7. The golf club head body 2202 includes a contact rim 2244 that projects toward the striking face 2204 from the ledge 2216 so as to support the inner wall 2206 along the topline portion 2208 and sole portion 2210. The contact rim 2244 creates a gap 2260 (see FIG. 24) between a rear surface of the striking face 2204 and the ledge 2216. The contact rim 2244 is not provided along the toe portion 2214 of the golf club head body 2202 so as to allow for the free insertion of the inner wall 2206 as described below. The golf club head body 2202 further includes a heel wall 2245 that supports a heelmost edge of the inner wall 2206 and a heelmost edge of the striking face 2204 as shown in FIG. 25.

Referring back to FIG. 23, the toe cap 2275 includes a threaded boss 2268 projecting from an inner surface thereof toward the toe portion 2214 of the golf club head body 2202. A fastener receiving hole 2264 is defined in the toe portion 2214 of the golf club head body 2202. A fastener receiving hole wall 2265 extends into the interior of the golf club head body 2202 so as to receive therein the threaded boss 2268 when the toe cap 2275 is fully installed. A threaded fastener 2266 is inserted from an interior of the golf club head body 2202 through the fastener receiving hole 2264 and mates with the threaded boss 2268 to secure the toe cap 2275 to the golf club head body 2202. With the toe cap 2275 secured in place, the inner wall 2206 is locked in place between the toe cap 2275, the ledge 2216, the contact rim 2244, the heel wall 2245, and a rear surface of the striking face 2204.

Referring to FIG. 24, a toe side view of the golf club head 2200 is provided with both the toe cap 2275 and the inner wall 2206 omitted to better illustrate certain features. The contact rim 2244 extends toward the striking face 2204 away from the ledge 2216 by a distance that is substantially equal to a thickness of the inner wall 2206, such that a gap 2260 having a width that is substantially equal to the thickness of the inner wall 2206 is defined between the rear surface of the striking face 2204 and the ledge 2216. Also visible in FIG. 24 is the heel wall 2245, which supports the heelmost extent of the inner wall 2206.

The manner in which the threaded boss 2268 fits within the fastener receiving hole 2264 to secure the toe cap 2275 to the golf club head body 2202 is clearly illustrated from the toe side view of FIG. 24. Also shown in FIG. 24 is a recess 2257 defined in the toe portion 2214 of the golf club head body 2202. The recess 2257 corresponds to the toe cap 2275 and has a depth sufficient to receive the toe cap 2275 such that the external contours of the toe cap 2275 blend with the external contour of the golf club head 2200. The recess 2257 may extend to the topline portion 2208 and/or the sole portion 2210, though the present invention is not limited in this regard.

FIG. 25 is a sectional view taken along the line XXV-XXV' in FIG. 23. It is noted that the toe cap 2275 is positioned higher than the golf club head body 2202 in the exploded view of FIG. 23, thus the fastener receiving hole 2264 and the threaded boss 2268 appear misaligned in FIG. 25. Further, the striking face 2204 and the inner wall 2206 are included in FIG. 25 to illustrate the manner in which the heel wall 2245, the ledge 2216, the toe cap 2275, and the striking face 2204 work in concert to support and secure the inner wall 2206. The gap 2260 between the ledge 2216 and the rear surface of the striking face 2204 is completely filled by the inner wall 2206 in a fore-aft direction extending rearward from the striking face 2204 toward the rear portion of the golf club head body 2202. As the inner wall 2206 completely fills the gap 2260, the ledge 2216 mechanically locks the inner wall 2206 in place. Moreover, as the inner wall 2206 reinforces the striking face 2204, the striking face 2204 may be thinner than it would otherwise be in absence of the inner wall 2206.

According to some embodiments, a release agent (not shown) may be interposed between the inner wall 2206 and the striking face 2204 to reduce friction therebetween, and ensure that the inner wall 2206 and the striking face 2204 are free to slide relative to each other during impact deformation during the striking of a golf ball. The release agent may include a release film, an anti-friction coating, or a mold release lubricant.

The sectional view of FIG. 25 also affords a clearer view of the complimentary structures of the fastener receiving hole 2264, the fastener receiving hole wall 2265, and the threaded boss 2268. Finally, FIG. 25 illustrates a tapered edge area 2232 of the inner wall 2206. The tapered edge area 2232 is defined around a perimeter of the inner wall 2206 and allows for deflection of the inner wall 2206 during striking of a golf ball, without applying a force to the striking face 2204, thus preventing inadvertent separation thereof from the golf club head body 2202. The benefits of the tapered edge area 2232 are described in detail above with regard to FIGS. 10A and 10B.

A golf club head 2600 in accordance with yet another embodiment is illustrated in FIGS. 26 through 29. Golf club head 2600 includes a golf club head body 2602 having a heel portion 2612, a toe portion 2614 opposite the heel portion 2612, a sole portion 2610, and a topline portion 2608 opposite the sole portion 2610. An inner wall 2606 is inserted through a toe opening 2670 defined in the toe portion 2614 of the golf club head body 2602. The inner wall 2606 is supported by a deformable member 2690 disposed between the inner wall 2606 and a back portion 2655 of the golf club head body 2602. The back portion 2655 includes a cantilevered support arm 2691 affixed to a cradle 2692, which applies a compressive force through the deformable member 2690 and the inner wall 2606 to the striking face 2604. The force applied to the back of the striking face 2604 by the cantilevered support arm 2691 through the deformable member 2690 and the inner wall 2606 reinforces the striking face 2604. As the inner wall 2606 reinforces the striking face 2604, the striking face 2604 may be thinner than it would otherwise be in absence of the inner wall 2606. The back portion 2655 and the deformable member 2690 are described in detail in U.S. Pat. No. 10,293,226 to Hebreo et al., which is incorporated herein by reference in its entirety.

According to an exemplary embodiment of the present invention, the inner wall 2606 may be formed out of a composite type material, fiberglass, or, preferably, carbon fiber. The deformable member 2690 may be formed of an elastic material, preferably a polymer.

The dimensions and position of the cradle 2692 and the deformable member 2690 may be adjusted to reinforce different areas of the striking face 2604. For example, the cradle 2692 and deformable member 2690 may contact and reinforce a majority of the area of the inner wall 2606, the cradle 2692 and deformable member 2690 may contact and reinforce an area of the inner wall 2606 corresponding to a geometric center of the striking face 2604, or the cradle 2692 and the inner deformable member 2690 may contact and reinforce an area of the inner wall 2606 that is toeward of the geometric center of the striking face 2604 where stresses may be highest.

Moreover, when an adhesive layer (not shown) is interposed between the striking face 2604 and the inner wall 2606, the force applied to the back of the striking face 2604 by the cantilevered support arm 2691 reinforces a bond between the striking face 2604 and the inner wall 2606.

Figure 27:
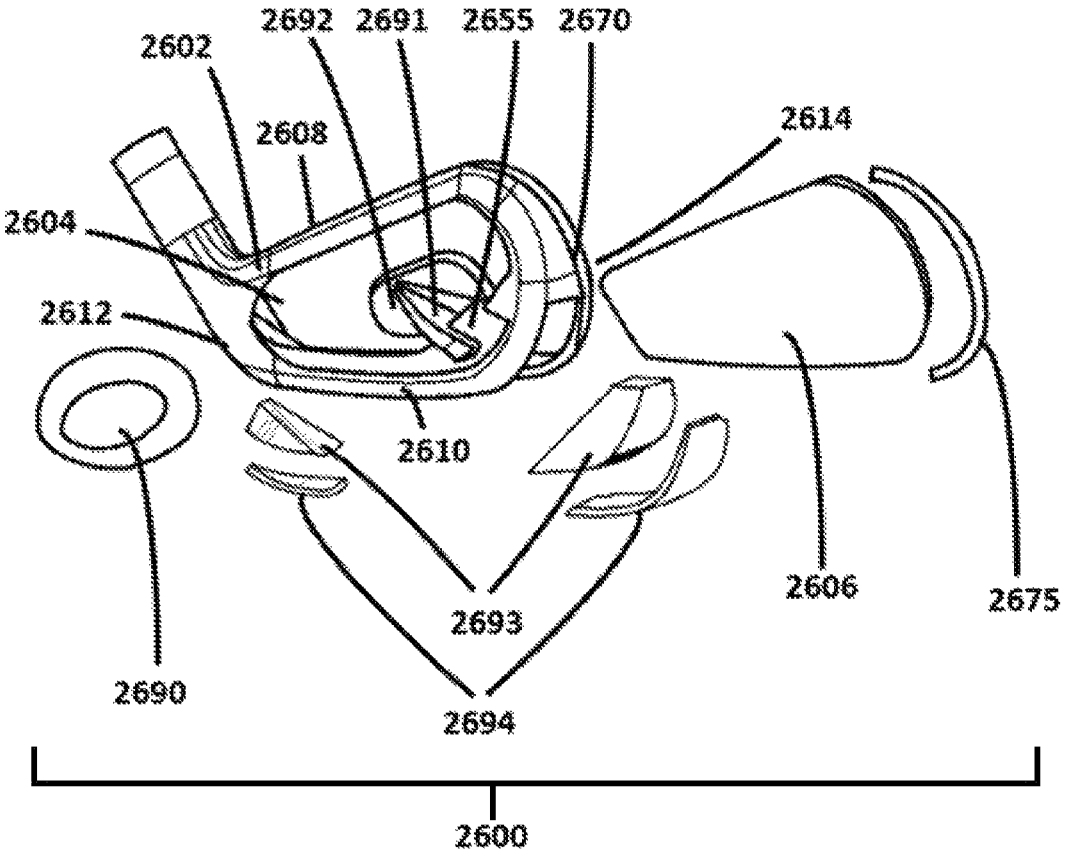
FIG. 27 is an exploded view of the golf club head of FIG. 26.

FIG. 27 provides an exploded perspective view of the golf club head 2600. As shown in FIG. 27, the back portion 2655 and the striking face 2604 may be joined to the golf club head body 2602 prior to insertion of the inner wall 2606 and the deformable member 2690. It is also within the scope of the present invention that the back portion 2655 be cast simultaneously with the golf club head body 2602.

FIG. 27 also illustrates high-density weights 2693 that may be inserted within openings defined in the toe portion 2614 and the heel portion 2612 of the golf club head body 2602. The high-density weights 2693 are preferably formed of tungsten and may be attached to the golf club head body 2602 by welding, brazing, swaging, adhesive, or any other suitable means. The high density weights 2693 may be exposed or may be concealed by weight caps 2694.

FIG. 27 more clearly shows the toe opening 2670 defined in the golf club head body 2602 for receiving the inner wall 2606 therethrough. After the inner wall 2606 is inserted into the golf club head body 2602, the toe opening 2670 may be concealed with a toe cap 2675 that may be formed of a lightweight but resilient material. For example a polymer such as urethane.

Figure 28:
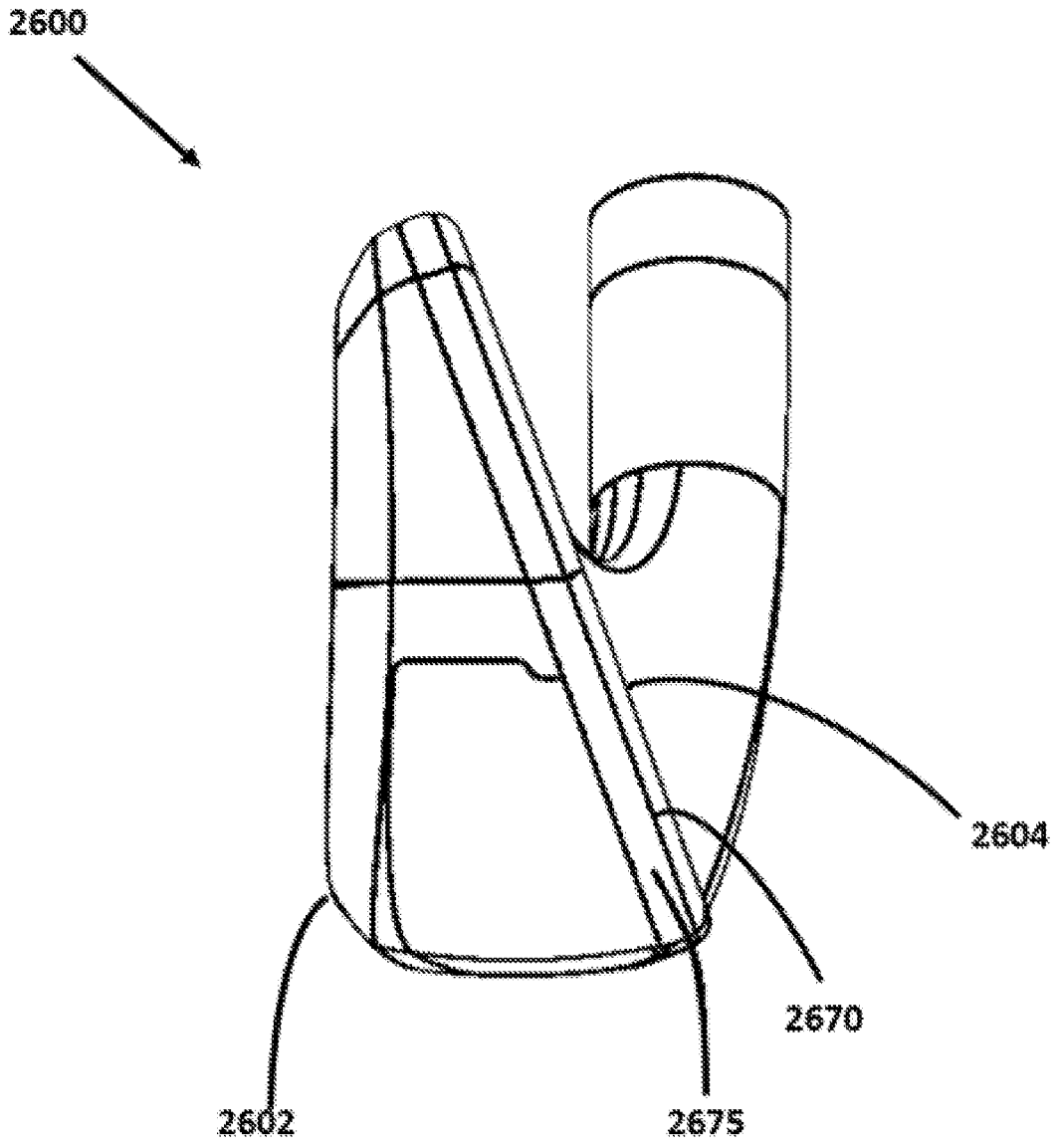
FIG. 28 is a toe side view of the golf club head of FIG. 26.

FIG. 28 provides a toe side view of the golf club head 2600 that illustrates how the toe cap 2675 conceals the toe opening 2670. As shown in FIG. 28, the toe cap 2675 is contoured to blend seamlessly with the golf club head body 2602 and the striking face 2604.

Figure 26:
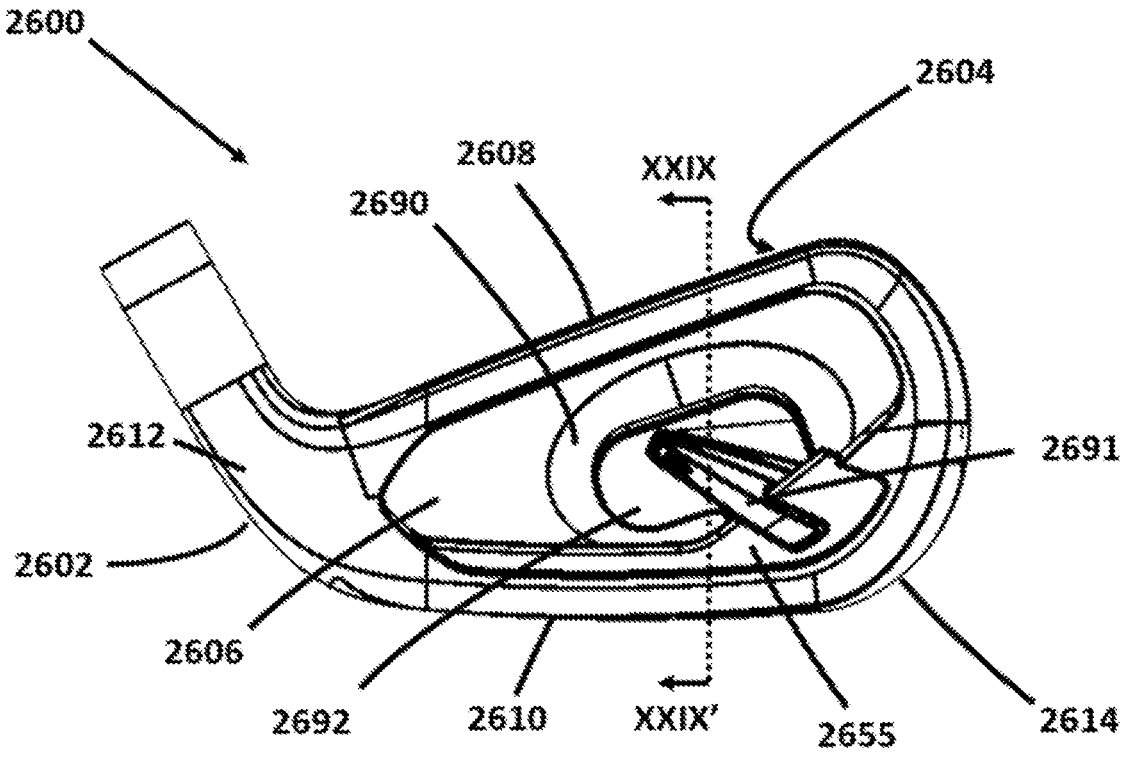
FIG. 26 is a rear view of another example of a golf club head having an inner wall.
Figure 29:
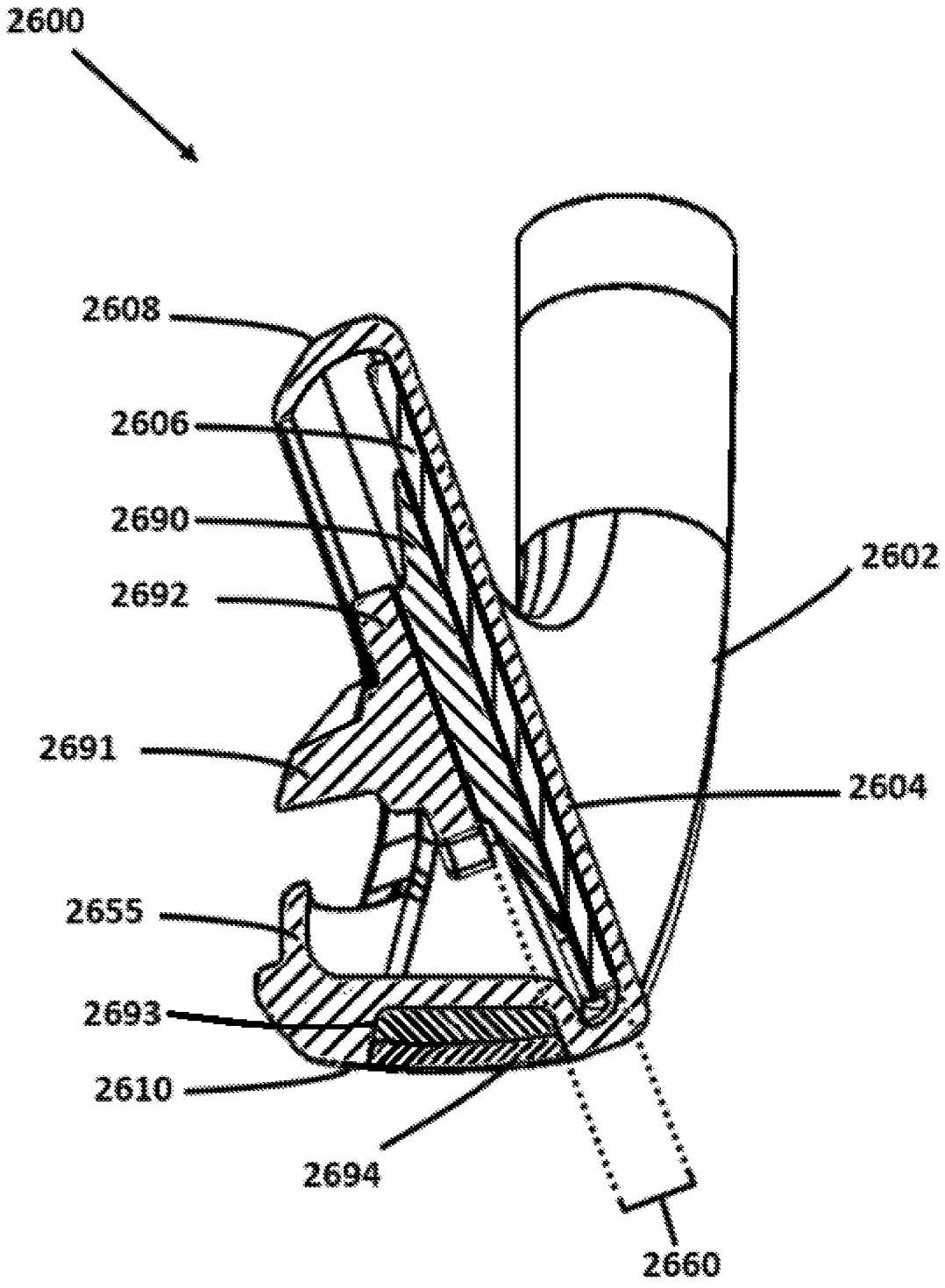
FIG. 29 is a sectional view of the golf club head of FIG. 26 taken along the line XXIX-XXIX' of FIG. 26.

FIG. 29 is a sectional view of the golf club head 2600 taken along the line XXIX-XXIX' in FIG. 26. As illustrated in FIG. 29, the cradle 2692 is spaced apart from a rear surface of the striking face 2604 so as to define a gap 2660 therebetween. The inner wall 2606 and the deformable member 2690 combine to completely fill the gap 2660 defined between a rear surface of the inner wall 2606 and the cradle 2692 in a fore-aft direction extending rearward from the striking face 2604 toward the rear portion of the golf club head body 2602, thereby mechanically locking the inner wall 2606 in place.

Although specific embodiments and aspects were described herein and specific examples were provided, the scope of the technology is not limited to those specific embodiments and examples. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

The invention claimed is:

1. A golf club head comprising:

a golf club head body, said golf club head body comprising:

a striking face;

a toe portion;

a heel portion opposite said toe portion;

a sole portion;

a topline portion opposite said sole portion; and a ledge extending toward an interior of said golf club head body from said sole portion, said toe portion, and said topline portion, wherein said ledge is not provided in said heel portion, wherein said ledge is spaced apart from a rear surface of said striking face so as to define a gap therebetween;

an inner wall comprising at least one of a composite material, fiberglass, and carbon fiber, wherein said inner wall is in contact with at least a portion of said rear surface of said striking face, and at least a portion of said inner wall is disposed in said gap; and a perimeter support member interposed between said inner wall and said ledge.

2. The golf club head of claim 1, wherein said inner wall and said perimeter support member completely fill said gap so as to mechanically lock said inner wall in place.

3. The golf club head of claim 1, wherein said perimeter support member comprises at least one of a resin, an epoxy, and a chopped fiber.

4. The golf club head of claim 1, wherein a release agent is interposed between said striking face and said inner wall to reduce friction therebetween.

5. The golf club head of claim 1, wherein said golf club head body further comprises a heel wall extending from said sole portion to said topline portion proximate said heel portion.

6. The golf club head of claim 5, wherein said inner wall and said perimeter support member abut said heel wall.

7. The golf club head of claim 6, wherein an upper portion of said heel wall proximate said topline portion has a first depth, a lower portion of said heel wall proximate said sole portion has a second depth, and a central portion of said heel wall between said upper portion and said lower portion has a third depth, wherein said third depth is less than said first depth and said second depth.

8. The golf club head of claim 7, wherein said third depth is about equal to a thickness of said inner wall, and wherein said first depth and said second depth are about equal to a combined thickness of said inner wall, said perimeter support member, and said ledge.

9. The golf club head of claim 1, wherein said club head body further comprises a rear opening defined in a rear portion of said club head body opposite said striking face, and wherein said rear opening is adapted to receive said inner wall therethrough.

* * * * *